US006731275B2

(12) United States Patent
Mizobata

(10) Patent No.: US 6,731,275 B2
(45) Date of Patent: May 4, 2004

(54) METHOD OF DRIVING AC-DISCHARGE PLASMA DISPLAY PANEL

(75) Inventor: Eishi Mizobata, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/453,424

(22) Filed: Jun. 3, 2003

(65) Prior Publication Data

US 2003/0193452 A1 Oct. 16, 2003

Related U.S. Application Data

(62) Division of application No. 09/481,203, filed on Jan. 11, 2000, now Pat. No. 6,573,878.

(30) Foreign Application Priority Data

Jan. 14, 1999 (JP) ..... 11-008469
Feb. 12, 1999 (JP) ..... 11-034407
Feb. 19, 1999 (JP) ..... 11-040860

(51) Int. Cl.[7] ..... G09G 5/00
(52) U.S. Cl. ..... 345/209; 345/60; 345/208
(58) Field of Search ..... 345/60, 61, 62, 345/63, 208, 209, 210, 211, 212, 213

(56) References Cited

U.S. PATENT DOCUMENTS 5,854,540 A * 12/1998 Matsumoto et al. ..... 315/169.1
5,877,734 A 3/1999 Amemiya
6,037,916 A * 3/2000 Amemiya ..... 345/60
6,160,529 A 12/2000 Asao et al.
6,181,305 B1 * 1/2001 Nguyen et al. ..... 345/60
6,219,013 B1 * 4/2001 Amano ..... 345/60
6,323,880 B1 11/2001 Yamada
6,483,487 B2 * 11/2002 Iseki ..... 345/60

FOREIGN PATENT DOCUMENTS

EP 0 488 891 6/1992
EP 0 549 275 B1 6/1993

(List continued on next page.)

OTHER PUBLICATIONS

"Cell Structure and Driving Method of a 25–In. (64–CM) Diagonal High Resolution Color AC Plasma Display" Hirakawa, et al., SID 98 Digest, pp. 279–282: XP–002139336.

*Primary Examiner*—Kent Chang
(74) *Attorney, Agent, or Firm*—Katten Muchin Zavis Rosenman

(57) ABSTRACT

A method of driving an ac-discharge type PDP is provided, which ensures a satisfactorily long sustain period and prevents the luminance of the display screen from lowering even if the count of the scan lines is increased. The PDP has row electrodes and column electrodes that form pixels arranged in a matrix array, and a dielectric layer formed to cover the pixels. In the step (a), scan pulses are applied successively to the row electrodes while data pulses are applied to the column electrodes according to a display signal in a scan period, thereby generating wall discharge in the dielectric layer due to writing discharge. The amount of the wall charge in each of the pixels varies according to the display signal. In the step (b), conversion discharge is caused in a conversion period after the scan period, thereby decreasing the amount of the wall charge in the pixels. The conversion discharge is caused in a different state in each of the pixels according to the amount of the wall charge. In the step (c) sustain pulses are applied to the row electrodes in a sustain period after the conversion period, thereby causing sustain discharge. The sustain discharge occurs in part of the pixels according to the state of the conversion discharge that has been caused in the conversion period, resulting in emission of light.

13 Claims, 22 Drawing Sheets

FOREIGN PATENT DOCUMENTS

| | | |
|---|---|---|
| EP | 0 549 275 A1 | 6/1993 |
| EP | 0 657 861 | 6/1995 |
| EP | 0 680 067 | 11/1995 |
| EP | 0 762 373 | 3/1997 |
| EP | 0 810 577 | 12/1997 |
| EP | 0 866 439 | 9/1998 |
| JP | 50-105023 | 8/1975 |
| JP | 50-135945 | 10/1975 |
| JP | 6-43829 | 2/1994 |
| JP | 7-191626 | 7/1995 |
| JP | 9-6280 | 1/1997 |
| JP | 09-034397 | 2/1997 |
| JP | 09-068946 | 3/1997 |
| JP | 09-311611 | 12/1997 |
| JP | 10-177363 | 6/1998 |
| JP | 10-307560 | 11/1998 |
| JP | 10-319900 | 12/1998 |
| JP | 10-319901 | 12/1998 |
| JP | 11-038931 | 2/1999 |
| JP | 11-109915 | 4/1999 |
| JP | 11-282416 | 10/1999 |
| JP | 2000-172226 | 6/2000 |

* cited by examiner (C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

(C1～Cm)

(S1)

(S2)

(Sm)

(D1～Dn)

METHOD OF DRIVING AC-DISCHARGE PLASMA DISPLAY PANEL

CROSS REFERENCE TO RELATED APPLICATIONS

This application is a Divisional Application of application Ser. No. 09/481,203, filed on Jan. 11, 2000 now U.S. Pat. No. 6,573,878. Another Divisional Application of application Ser. No. 09/481,203, application Ser. No. 10/453,774, was filed on Jun. 3, 2003.

BACKGROUND OF THE INVENTION

1. Field of the Invention

The present invention relates to a plasma display panel (PDP) and more particularly, to a method of driving a PDP having a preliminary discharge period for applying a preliminary discharge pulse or pulses to scan electrodes, a scan period for applying successively scan pulses to the individual scan electrodes, and a sustain period for applying sustain pulses to the scan electrodes.

2. Description of the Prior Art

PDPs have a lot of advantages such that they can be readily fabricated as large-sized flat display panels, and they can provide a wide field angle of view and quick response. Thus, in recent years, they have been used for flat display devices of various computers, wall-mounted television (TV) sets, public information display panels, and so on.

PDPs are generally classified into two groups with respect to their driving method; the direct current (dc) discharge type and the alternate current (ac) discharge type. In the dc-discharge type, the electrodes are exposed to the discharge space (i.e., the discharge gas) and the PDP is driven by using the dc discharge. The dc discharge is kept for the period when the dc driving voltage is applied. On the other hand, in the ac-discharge type, the electrodes are covered with the dielectric layer not to be exposed to the discharge space (i.e., the discharge gas) and the PDP is driven by using the ac discharge. The discharge is kept by the repetitive polarity reversal of the ac driving voltage.

Since the invention relates to the ac-discharge type PDP, the explanation will be made to only the ac-discharge type PDP.

The ac-discharge type PDP is classified into two groups with respect to the electrode count in each discharge cell or pixel; the two-electrode type and the three-electrode type. A typical example of the three-electrode type PDPs is shown in FIGS. 20 and 21.

FIG. 20 shows the configuration of the discharge cell of the three-electrode type PDP. FIG. 21 shows the layout of the electrodes of this PDP.

As shown in FIGS. 20 and 21, this PDP includes front substrate 20 and a rear substrate 21 fixed together to be opposite to each other. These substrates 20 and 21, each of which are usually made of a glass plate, are arranged parallel to and apart from each other by a specific distance.

A plurality of scan electrodes 22 (i.e., S1, S2, . . . , Sm) are formed to be parallel to each other on the inner surface of the front substrate 20, where m is an integer greater than unity. A plurality of common electrodes 22 (i.e., C1, C2, . . . , Cm) are formed to be parallel to each other on the same inner surface of the front substrate 20. The scan electrodes 22 and the common electrodes 23 extend in the same direction (the lateral direction in FIG. 21) alternately. A transparent dielectric layer 24 is formed on the inner surface of the substrate 20 to cover the scan electrodes 22 and the common electrodes 23. On the dielectric layer 24, a protection layer 25, which is made of MgO, is formed to protect the layer 24 from the discharge.

On the other hand, a plurality of data electrodes 29 (i.e., D1, D2, . . . , Dn) are formed to be parallel to each other on the inner surface of the rear substrate 21, where n is an integer greater than unity. The data electrodes 29 are perpendicular to the scan electrodes 22 and the common electrodes 23. A white dielectric layer 28 is formed on the inner surface of the substrate 21 to cover the data electrodes 29. On the dielectric layer 28, a phosphor layer 27 is formed to emit visual light.

A plurality of partition walls (not shown) are formed to extend parallel to the data electrodes 29 in the space between the front and rear substrates 20 and 21. These walls serve to form the discharge spaces 26 between the substrates 20 and 21 and the display cells or pixels 31. The cells 31 are arranged in a matrix array. A specific discharge gas such as He, Ne, Xe, or the like is confined into the spaces 26.

The above-described PDP configuration has been disclosed in various documents, an example of which is the paper, Society for Information Display (SID) 98 Digest, entitled "Cell Structure and Driving Method of a 25-in. (64-cm) Diagonal High-Resolution Color ac Plasma Display", pp. 279–281, May 1998.

Next, a prior-art driving method of the three-electrode, ac-discharge type PDP shown in FIGS. 20 and 21 is described below. This method is one of the so-called Address Display period Separated sub-field (ADS) methods, which has formed the main stream of methods of this sort.

FIGS. 1A to 1E are waveform charts for explaining this prior-art driving method during one of the sub-fields T1. The sub-field T1 is formed by a preliminary discharge period T2, a scan period T3, and a sustain period T4.

In the preliminary discharge period T2, a preliminary discharge pulse 114 (which is negative here) is commonly applied to the common electrodes 23 (i.e., C1 to Cm). Thus, the difference in wall-charge formation state in the preceding, adjoining sub-field T1 is reset or eliminated for initialization. At the same time as this, ac discharge is caused in all the discharge cells 31 to eliminate the data contained therein, thereby enabling the next writing discharge to occur at a low applied voltage, i.e., enabling the "priming effect" to occur. As a result, the preliminary discharge pulse 114 needs to have an amplitude or voltage level greater than those of the scan pulses and the sustain pulses described later.

One preliminary discharge pulse 114 is used in FIG. 1A. However, two roles of eliminating the difference in wall-charge formation state and of causing the priming effect may be performed by respective pulses. Specifically, a sustain-discharge elimination pulse for resetting the state in the prior sub-field may be applied to the common electrodes 23 (i.e., C1 to Cm) and then, a priming pulse for generating the priming effect in all the cells 31 may be applied thereto. In this case, the count of the sustain-discharge elimination pulses is not limited to unity. It may be two or more.

The priming effect is not necessary for every sub-field. In some driving methods, only a single priming pulse is applied during several successive sub-fields. The priming pulse activates all the cells 31 to emit light independent of whether the cells 31 have displayed information or not. Therefore, if the count of the priming pulses is decreased, the luminance at the time when the cells 31 display black color can be suppressed.

If the preliminary discharge pulse 114 as shown in FIG. 1A is used, to cause a single priming operation during several successive sub-fields, the voltage level or amplitude of the pulse 114 may be set to be low enough for performing only the resetting operation. In this case, to ensure the resetting operation, another pulse or pulses may be applied several times, instead of the pulse 114.

Subsequent to the preliminary discharge pulse 114, a preliminary-discharge elimination pulse 115 (which is negative here) is commonly applied to the scan electrodes 22 (S1 to Sm) in the preliminary discharge period T2. Thus, the wall charge, which have been induced in the dielectric layers 24 and 28 by preliminary discharge due to the preliminary discharge pulse 114, are eliminated or controlled to desired amount.

In FIGS. 1B to 1D, one preliminary-discharge elimination pulse 115 is applied, two or more pulses 115 may be applied to the scan electrodes 22 to ensure the roles of the scan pulses and the sustain pulses, to suppress the fluctuation of the light-emitting state in all the cells 31, and to cope with the load fluctuation for displaying behavior. The preliminary-discharge elimination pulse or pulses 115 may be applied to other electrodes than the scan electrodes 22 also.

Then, in the scan period T3, scan pulses 109 (which are negative here) are successively applied to the respective scan electrodes 22 (i.e., D1 to Dn), as shown in FIGS. 1B to 1D. Here, a scan bias pulse 112 is kept applied to the scan electrodes 22 in the whole period T3 and the scan pulses 109 are superposed to this bias pulse 112. In response to the scan pulses 109 thus applied, data pulses 110 (which are positive here) are applied to specific ones of the data electrodes 29 according to a required display pattern in this period T3, as shown in FIG. 1E.

In the cells 31 applied with the data pulses 109, a high voltage is applied across the corresponding scan and data electrodes 22 and 29 and therefore, writing discharge occurs. Thus, a large amount of positive wall charge is induced in the dielectric layer 24 covering the scan and common electrodes 22 and 23 while a large amount of negative wall charge is induced in the dielectric layer 28 covering the data electrodes 29. On the other hand, in the cells 31 applied with no data pulses 109, only a low voltage is applied across the corresponding scan and data electrodes 22 and 29 and therefore, writing discharge does not occur and the state of the wall charge that has been formed in the prior sub-field T1 is not changed. As described above, two different states of the wall charge can be generated according to the existence or absence of the data pulse 110.

The slashes (i.e., oblique lines) shown in the data pulses 110 in FIG. 1E denote the fact that the existence or absence of the data pulse 110 changes according to the display data.

When the application of the scan pulses 109 to all the scan electrodes 22 (S1 to Sm) is completed, the sustain period T4 begins, in which sustain pulses 111 (which are positive) are alternately applied to all the scan electrodes 22 and all the common electrodes 23 (C1 to Cn). The amplitude or voltage level of the sustain pulses 111 are set to be low enough for starting the discharge. Therefore, in the cells 31 where no writing discharge has occurred and the amount of the wall charge has been small or zero, no sustain discharge occurs even if the sustain pulses 111 are applied to the scan or common electrodes 22 or 23.

Unlike this, sustain discharge occurs in the cells 31 where some writing discharge has occurred and a large amount of wall charge has been generated. This is because the first one of the applied sustain pulses 111 (i.e., the first sustain pulse), which is commonly applied to the scan electrodes 22, is added or superposed to the remaining positive wall charge existing in the dielectric layer 24 over the scan electrode side and consequently, a resultant voltage applied across the spaces 26 exceeds the specific discharge-starting voltage. Due to this sustain discharge, negative charge is induced and accumulated on the scan electrode side and at the same time, positive charge is induced and accumulated on the common electrode side.

Next, when the second one of the sustain pulses 111 (i.e., the second sustain pulse) is applied to the common electrodes 23, it is superposed to the remaining positive wall charge existing in the dielectric layer 24 on the common electrode side and consequently, a resultant voltage applied across the spaces 26 exceeds the specific discharge-starting voltage. Thus, opposite-polarity wall charge to that of the first sustain pulse 111 is induced and accumulated on the scan electrode and common electrodes sides, respectively.

Since the above-described steps are repeated in the whole sustain period T4, the sustain discharge is kept during the period T4 in the light-emitting cells 31.

As explained above, the sustain discharge is kept by the phenomenon that the potential difference (or voltage) caused by the wall charge that has been induced by the x-th sustain pulse 111 is superposed to the voltage of the (x+1)-th sustain pulse 111. The count (i.e., the repetition number) of the sustain pulses 111 determines the amount of emitted light.

The combination of the successive sub-fields T1 constitutes the "field" which is defined as a period for displaying a piece of image information on the display area of the PDP. As described previously, each of the sub-fields T1 is formed by the preliminary discharge period T2, the scan period T3, and the sustain period T4. Thus, if the count of the sustain pulses 111 is changed in each of the sub-fields T1, the display tone (i.e., the intensity levels) on the screen of the PDP can be adjusted optionally.

With the above-explained prior-art method of driving the PDP with reference to FIGS. 1A to 1E, if this method is applied to high-resolution display panels, the scan period T3 needs to be extended or prolonged due to the increase in scan lines (i.e., the count of the scan pulses 109). This means that if the length of the sub-field T1 and that of the preliminary discharge period T2 are fixed, the sustain period T4 needs to be shortened according to the extension of the scan period T3. As a result, there is a problem that the light-emitting period in the sub-field T1 is reduced to thereby lower the luminance of the display screen.

Next, another prior-art driving method of the three-electrode, ac-discharge type PDP shown in FIGS. 20 and 21 is described below. This method also is of the so-called ADS type.

FIGS. 2A to 2E are waveform charts for explaining this prior-art driving method during one of the sub-fields T1. The sub-field T1 is formed by a preliminary discharge period T2, a scan period T3, and a sustain period T4, which is the same as that of the prior-art method of FIGS. 1A to 1E.

In the preliminary discharge period T2, a preliminary discharge pulse 212 is commonly applied to the common electrodes 23 (i.e., C1 to Cm). Thus, the difference in wall-charge formation state in the preceding, adjoining sub-field T1 is reset or eliminated for initialization. At the same time as this, ac discharge is caused in all the discharge cells 31 to eliminate the data written therein, thereby enabling the next writing discharge to occur at a satisfactorily low voltage, i.e., generating the "priming effect". As a result, the preliminary discharge pulse 212 needs to have an amplitude greater than those of the scan pulses and the sustain pulses described later. This is the same as that described in the prior-art method of FIGS. 1A to 1E.

Similar to the described in the prior-art method of FIGS. 1A to 1E, two roles of eliminating the difference in wall-charge formation state and of causing the priming effect of the pulse 212 may be performed by two pulses. Specifically, a discharge elimination pulse for resetting the state in the prior sub-field T1 may be applied to the common electrodes 23 and then, a priming pulse for generating the priming effect in all the cells 31 may be applied thereto. The count of the discharge elimination pulse may be two or more.

The priming effect is not necessary for every sub-field T1. The priming pulse activates all the cells 31 to emit light independent of whether the cells 31 have displayed information or not. Therefore, if the count of the priming pulses is decreased, the luminance at the time when the cells 31 display a black color can be suppressed.

If the preliminary discharge pulse 212 as shown in FIG. 2A is used, to cause a single priming operation during several successive sub-fields T1, the level or amplitude of the pulse 212 may be set to be low enough for performing only the resetting operation. In this case, to ensure the resetting operation, another pulse may be applied several times, instead of the pulse 212.

Subsequently, a preliminary-discharge elimination pulse 207 is commonly applied to the scan electrodes 22 (S1 to Sm) in the preliminary discharge period T2. Thus, the wall charge, which has been induced in the dielectric layers 24 and 28 by the preliminary discharge, is eliminated or controlled to a desired amount.

In FIG. 2B, a preliminary-discharge elimination pulse 207 is applied, two or more pulses 217 may be applied to the electrodes 22 to ensure the roles of the scan and sustain pulses, to suppress the fluctuation of the light-emitting state in all the cells 31, and to cope with the load fluctuation for displaying behavior. The preliminary-discharge elimination pulse or pulses 207 may be applied to other electrodes than the scan electrodes 22 also.

Then, in the scan period T3, scan pulses 208 are successively applied to the respective scan electrodes 22 (i.e., S1 to Sm), as shown in FIGS. 2B to 2D. In response to the scan pulses 208, data pulses 209 are applied to specific ones of the data electrodes 29 (i.e., D1 to Dn) according to a required display pattern, as shown in FIG. 2E.

In the cells 31 applied with the data pulses 209, a high voltage is applied across the scan and data electrodes 22 and 29 and therefore, writing discharge occurs. As a result, a large amount of positive wall charge is induced over the scan electrodes 22 and a large amount of negative wall charge is induced over the data electrodes 29. On the other hand, in the cells 31 applied with no data pulses 209, only a low voltage is applied across the scan and data electrodes 22 and 29 and therefore, writing discharge does not occur. Thus, the state of the wall charge is not changed over the scan and data electrodes 22 and 29. Accordingly, two different states of the wall charge can be formed according to the existence or absence of the data pulse 209.

The slashes shown in the data pulses 209 in FIG. 2E denote the fact that the existence or absence of the data pulse 209 changes according to the required display data.

When the application of the scan pulses 208 to all the scan electrodes 22 (S1 to Sm) is completed, the sustain period T4 begins, in which sustain pulses 210 are alternately applied to all the scan electrodes 22 and all the common electrodes 23 (C1 to Cn). Unlike the above-described prior-art method of FIGS. 1A to 1E, the pulses 210 have a negative polarity.

The amplitude or voltage value of the pulses 210 are set to be low enough for preventing the discharge. Therefore, even if the sustain pulses 210 are applied, no discharge occurs in the cells 31 where no writing discharge has occurred in the scan period T3 and as a result, the amount of the wall charge is small. Unlike this, sustain discharge occurs in the cells 31 where some writing discharge has occurred in the scan period T3 and as a result, positive wall charge exists or remains over the scan electrodes 22. This is because the first one of the sustain pulses 210 (i.e., the first sustain pulse) is added or superposed to the remaining positive wall charge and consequently, a voltage higher than the discharge-starting voltage is applied across the space 26, generating the sustain discharge. Due to this sustain discharge, negative charge is induced and accumulated over the scan electrodes 22 and positive charge is induced and accumulated over the common electrodes 23.

Then, the second one of the sustain pulses 210 (i.e., the second sustain pulse) is applied to the common electrodes 23 to induce the above-identified wall charge and then, it is superposed thereto. Thus, opposite-polarity wall charge to that by the first sustain pulse 210 is induced and accumulated over the scan electrodes 22. Subsequently, the same steps are repeated, thereby sustaining the discharge in the light-emitting cells 31.

As described above, similar to the above-described prior-art method of FIGS. 1A to 1E, the sustain discharge is kept by superposing the potential difference caused by the wall charge induced by the x-th sustain discharge to that by the (x+1)-th sustain pulse 210. The count (i.e., the repetition number) of the sustain pulses 210 in the period T4 determines the amount of emitted light.

With the above-explained prior-art method of driving the PDP with reference to FIGS. 2A to 2E, there arises the following problems:

Specifically, since the preliminary discharge pulse 212 is commonly applied to the common electrodes 23 to perform the resetting operation and to cause the priming effect in the preliminary discharge period T2, the voltage applied across the discharge spaces 26 varies dependent upon the state of the wall charge that has been generated in the previous sub-field T1. In other words, the voltage applied across the discharge spaces 26 is equal to a voltage obtained by superposing the wall charge to the applied pulse voltage, in which the amount of the wall charge varies according to whether or not the corresponding cells 31 have emitted light in the previous sub-field T1. Thus, the spaces 26 are applied with different voltages according to the state of the corresponding cells 31 in the previous sub-field T1.

On the other hand, because the level of the priming effect changes according to the voltage applied across the spaces 26, the starting voltage of the subsequent writing discharge in the scan period T3 will vary. As a result, according to whether or not the corresponding cells 31 have emitted light in the previous sub-field T1, there arises a problem that display error tends to occur. For example, some cells 31 that have driven to emit light do not emit light in error, and vice versa.

Moreover, if the sustain elimination pulse and the priming pulse are used in the preliminary discharge period 2, the resetting operation is carried out by the sustain elimination pulse and then, the priming pulse is applied. Therefore, the above problem of error light emission of the cells 31 is difficult to arise. In this case, however, the preliminary discharge period 2 becomes longer and as a result, the scan period T3 needs to be extended. This means that if the length of the sub-field T1 is fixed, the sustain period T4 needs to be shortened by the extension of the preliminary discharge period T2. As a result, there arises another problem that the light-emitting period becomes shorter to lower the luminance of the display screen.

The Japanese Non-Examined Patent Publication No. 6-43829 published in February 1994 discloses a similar driving method of a PDP to the prior-art method of FIGS. 2A to 2E, in which an address period and a sustain period are used for writing the display data into all discharge cells. In the address period, wall charge required for sustain discharge is generated according to the display data. In the sustain period, the sustain discharge is repeated for emitting light. The successive driving for generating the wall charge in the sustain period according to the display data is carried out in the interlaced scanning manner. Thus, the luminance of the display screen is improved and a stable driving state is realized.

FIGS. 3A to 3E are waveform charts for explaining a further prior-art driving method during one of the sub-fields T1. Similar to the prior-art method of FIGS. 2A to 2E, the sub-field T1 is formed by the preliminary discharge period T2, the scan period T3, and the sustain period T4.

In the preliminary discharge period T2, a preliminary discharge pulse 305 is commonly applied to the common electrodes 23. Thus, the difference in wall-charge formation state in the preceding, adjoining sub-field T1 is reset and all the existing wall charge is discharged to be eliminated for initialization. At the same time as this, ac discharge is caused in all the discharge cells 31 to eliminate the data contained therein, thereby enabling the next writing discharge to occur at a low applied voltage, i.e., generating the "priming effect". As a result, the preliminary discharge pulse 305 needs to have an amplitude greater than those of the scan pulses and the sustain pulses. This is the same as that described in the prior-art method of FIGS. 1A to 1E.

Next, a preliminary-discharge elimination pulse 306 is commonly applied to the scan electrodes 22, eliminating the wall charge existing in the dielectric layer 24 or controlling suitably the amount of this wall charge.

In the scan period T3, scan pulses 307 are successively applied to the scan electrodes 22 while data pulses 308 are suitably applied to the data electrodes 29 according to the display data, causing writing discharge to write the display data into the corresponding cells 31.

In the sustain period T4, sustain pulses 309 are commonly and alternately applied to the scan and common electrodes 22 and 23, emitting light from the corresponding cells 31.

As described above, the sustain discharge is kept by superposing the potential difference caused by the wall charge induced by the x-th sustain discharge to that induced by the (x+1)-th sustain pulse 309. The count (i.e., the repetition number) of the sustain pulses 309 determines the amount of emitted light.

On the other hand, the field, which is a period for displaying a piece of image information on the display area, is formed by a plurality of sub-fields T1. As described previously, each sub-field T1 includes the preliminary discharge period T2, the scan period T3, and the sustain period T4. If the count of the sustain pulses 111 is changed in each sub-field T1, the display tone (i.e., the intensity levels) can be adjusted.

With the above-explained prior-art method of driving the POP with reference to FIGS. 3A to 3E, the potential of the data electrodes 29 is equal to the ground level (i.e., approximately 0 V) at the time when the positive first sustain pulse 309 is applied to the scan electrodes 22. Therefore, the positive voltage of the first sustain pulse 309 is superposed to the voltage caused by the positive and negative wall charge existing respectively over the scan electrodes 22 and the data electrodes 29 that has been generated by the writing discharge in the scan period T3. As a result, a large voltage is applied across the discharge spaces 26 between the scan and common electrodes 22 and 23. Accordingly, the voltage applied to the discharge spaces 26 between the scan and data electrodes 22 and 29 is higher than that applied to the spaces 26 between the scan and common electrodes 22 and 23. This means that opposing discharge occurs prior to sustain discharge, thereby causing wall charge over the scan electrodes 22. Consequently, the voltage or potential difference between the scan and common electrodes 22 and 23 is lowered to hinder generation of sustain discharge. Thus, there is a possibility that the cells 31 do not emit light in spite of the applied sustain pulses 309.

In this case, the state of the wall charge that has generated in the prior sub-field T1 is difficult to be reset completely, resulting in false emission of light.

SUMMARY OF THE INVENTION

Accordingly, an object of the present invention to provide a method of driving an ac-discharge type PDP that ensures a satisfactorily long sustain period even if the count of the scan lines is increased.

Another object of the present invention to provide a method of driving an ac-discharge type PDP that prevents the luminance of the display screen from lowering even if the count of the scan lines is increased.

Still another object of the present invention to provide a method of driving an ac-discharge type PDP that causes the priming effect at approximately the same level independent of whether the pixels or discharge cells have emitted light or not in a prior sub-field.

Still another object of the present invention to provide a method of driving an ac-discharge type PDP that prevents the pixels or discharge cells from emitting light or not in error and that enables the PDP to operate stably.

A further object of the present invention to provide a method of driving an ac-discharge type PDP that ensures the resetting operation of the state of the wall charge or light emission in the previous sub-field in the preliminary discharge period.

A further object of the present invention to provide a method of driving an ac-discharge type PDP that ensures the sustain discharge of the discharge cells that have emitted light in the previous sub-field at the beginning of the sustain period.

The above objects together with others not specifically mentioned will become clear to those skilled in the art from the following description.

According to a first aspect of the present invention, a method of driving an ac-discharge PDP is provided, in which the PDP has row electrodes and column electrodes that form pixels arranged in a matrix array, and a dielectric layer formed to cover the pixels.

The method comprises the steps of:

(a) Scan pulses are applied successively to the row electrodes while data pulses are applied to the column electrodes according to a display signal in a scan period, thereby generating wall discharge in the dielectric layer due to writing discharge.

An amount of the wall charge in each of the pixels varies according to the display signal.

(b) Conversion discharge is caused in a conversion period after the scan period, thereby decreasing the amount of the wall charge in the pixels.

The conversion discharge is caused in a different state in each of the pixels according to the amount of the wall charge.

(c) Sustain pulses are applied to the row electrodes in a sustain period after the conversion period, thereby causing sustain discharge.

The sustain discharge occurs in part of the pixels according to the state of the conversion discharge that has been caused in the conversion period, resulting in emission of light.

With the method according to the first aspect of the present invention, the conversion period is provided between the scan period and the sustain period to cause the conversion discharge, thereby decreasing the amount of the wall charge in the pixels. The conversion discharge is caused in a different state in each of the pixels according to the amount of the wall charge.

Also, the sustain discharge occurs in the sustain period in the part of the pixels according to the state of the conversion discharge that has been caused in the conversion period, resulting in emission of light. In other words, the emission of light from the pixels is determined according to the state of the conversion discharge.

Accordingly, the voltage applied to the row electrodes in the scan period for causing the writing discharge can be raised, which decreases the width of the scan pulses. As a result, even if the count of the scan lines is increased, the length of the scan period can be kept short. This means that a satisfactorily long sustain period is ensured and the luminance of the display screen is prevented from lowering in spite of increase in the count of the scan lines.

In a preferred embodiment of the method according to the first aspect, the writing discharge occurs in the scan period in both of the pixels to emit light and the pixels not to emit light. In this embodiment, there is an additional advantage that the voltage applied to the row electrodes in the scan period for causing the writing discharge can be further raised, which decreases the width of the scan pulses more.

In another preferred embodiment of the method according to the first aspect, a voltage causing the writing discharge in the pixels not to emit light is higher than that in the pixels to emit light. The conversion discharge occurs in the pixels not to emit light and does not occur in the pixels to emit light in the conversion period. In this embodiment, there is an additional advantage that the waveform of the scan pulses can be simplified.

In still another preferred embodiment of the method according to the first aspect, a voltage across the row and column electrodes between which the writing discharge has occurred in the scan period is equal to substantially zero in said conversion period. In this embodiment, there is an additional advantage that the wall charge in the pixels not to emit light can be substantially eliminated and as a result, the margin between the pixels in which the sustain discharge occurs and those in which the sustain discharge does not occur.

In a further preferred embodiment of the method according to the first aspect, a preliminary discharge period for generating a preliminary discharge opposite in polarity to the writing discharge between the row and column electrodes is further provided prior to the scan period. The preliminary discharge is caused by a pulse opposite in polarity to the scan pulses applied to the row electrodes. The preliminary discharge generates preliminary wall charge opposite in polarity to the wall charge generated by the writing discharge in the scan period. In this embodiment, there is an additional advantage that a higher voltage can be applied across the row and column electrodes at the writing discharge and as a result, the length of the scan pulses can be further shortened.

In a still further preferred embodiment of the method according to the first aspect, a first scan bias pulse is commonly applied to the scan electrodes before application of the scan pulses, and a second scan bias voltage is commonly applied to the scan electrodes after application of the scan pulses in the scan period. The first scan bias pulse is equal in polarity to the scan pulses and has an amplitude (or absolute value) less than that of the scan pulses. Alternately, the first scan bias pulse is opposite in polarity to the scan pulses. The second scan bias pulse has an amplitude (or absolute value) greater than that of the first scan bias pulse and less than that of the scan pulses. In this embodiment, there is an additional advantage that error discharge can be prevented from occurring in the scan period.

In a still further preferred embodiment of the method according to the first aspect, the row electrodes are divided into two or more groups. Transition timing from the scan period to the conversion period for the respective groups of the row electrodes is shifted by a specific period. In this embodiment, there is an additional advantage that the peak current that flows in the conversion period can be decreased.

According to a second aspect of the present invention, another method of driving an ac-discharge PDP is provided.

The method comprises the steps of:

(a) A first preliminary discharge pulse is commonly applied to the row electrodes in a preliminary discharge period.

The first preliminary discharge pulse serves to induce discharge only when discharge has occurred in an adjoining, previous sustain period.

(b) A second preliminary discharge pulse is commonly applied to the row electrodes in the preliminary discharge period.

The second preliminary discharge pulse serves to induce discharge only when discharge has not occurred in the adjoining, previous sustain period.

(c) Scan pulses are applied successively to the row electrodes while data pulses are applied to the column electrodes according to a display signal in a scan period subsequent to the preliminary discharge period, thereby generating wall discharge in the dielectric layer due to writing discharge.

(d) Sustain pulses are applied to the row electrodes in a sustain period subsequent to the scan period, thereby causing sustain discharge.

A state of wall charge that has been generated in the adjoining, previous sustain period is reset by the first or second preliminary discharge pulse for initialization in the preliminary discharge period.

With the method according to the second aspect of the present invention, the first preliminary discharge pulse serving to induce discharge only when discharge has occurred in the adjoining, previous sustain period and the second preliminary discharge pulse serving to induce discharge only when discharge has not occurred in the same previous sustain period are applied in the same preliminary discharge period. Thus, the state of the wall charge that has been generated in the adjoining, previous sustain period of the previous sub-field can be reset by the first or second preliminary discharge pulse independent of whether the pixels or discharge cells have emitted light or not in the prior sub-field.

At the same time as this, the existing wall charge can be equalized to each other by the first or second preliminary discharge pulse, even if the amount of the existing wall charge is different at the beginning of the previous discharge period. Therefore, almost the same priming effect can be given independent of whether the cells have emitted light or not in the previous sustain period.

Accordingly, the problem that the cells or pixels emit light or not in error can be solved and the PDP can be operated stably, in which no sustain-discharge elimination pulse is used.

If the PDP is of the three-electrode type having scan electrodes, common electrodes, and data electrodes and at the same time, different amounts of wall charge is generated over these electrodes, respectively, the existing wall charge is difficult to be eliminated by applying a single pulse. In the present invention, the wall charge over the data electrodes is decreased to an approximate zero level. Thus, the elimination of the wall charge generated over the scan, common, and data electrodes can be facilitated, even if the wall charges generated over these electrodes have different amounts.

In a preferred embodiment of the method according to the second aspect, the potential difference or voltage between the row electrodes (e.g., the scan and data electrodes) at a time when the first preliminary discharge pulse is applied is less than that when the second preliminary discharge pulse is applied.

In another preferred embodiment of the method according to the second aspect, the first preliminary discharge pulse is applied to the row electrodes prior to the second preliminary discharge pulse.

In still another preferred embodiment of the method according to the second aspect, the first and second preliminary discharge pulses are applied to the same row electrodes as those applied with the last sustain pulse in the sustain period, thereby reversing the polarity of the potential difference between the row and column electrodes.

In a further embodiment of the method according to the second aspect, the potential difference between the row and column electrodes at a time when the first preliminary discharge pulse is applied is less than that at a time when the second preliminary discharge pulse is applied by a voltage of the sustain pulse. In this embodiment, there is an additional advantage that the first and second preliminary discharge pulses have substantially equal discharge strength, equalizing the levels of the priming effect to each other.

In a further embodiment of the method according to the second aspect, the timing of the preliminary discharge, scan, and sustain periods for all the cells are equal to each other.

In a further embodiment of the method according to the second aspect, the row electrodes of the PDP includes common electrodes and scan electrodes and the column electrodes thereof include data electrodes. The common electrodes and the scan electrodes extending parallel to each other. The data electrode extend perpendicular to the scan and common electrodes. This means that the PDP is of the three-electrode type. In this case, it is preferred that the first and second preliminary discharge pulses are commonly applied to the scan and common electrodes. There arises an additional advantage that the amount of the wall charge generated by the sustain pulse in the prior sub-field can be adjusted to a suitable value by the first preliminary discharge pulse.

In a further embodiment of the method according to the second aspect, the potential or voltage of the data electrodes is set at a value existing between the potentials or voltages of the scan electrodes and the common electrodes. There is an additional advantage that the amount of the wall charge generated over the data electrode can be decreased.

In a further embodiment of the method according to the second aspect, the potential difference or voltage between the scan and data electrodes is set to be equal to approximately half of the potential difference or voltage between the scan and common electrodes. There is an additional advantage that the subsequent wall-charge elimination can be facilitated, which decreases the necessary number of the wall-charge-elimination pulses.

In a further embodiment of the method according to the second aspect, the potential or voltage of the data electrodes in the preliminary discharge period is equal to one of two potential or voltage values of the data electrodes according to whether the cells emit light or not in the scan period. There is an additional advantage that the setting of voltage of the data driver is unnecessary.

In a further embodiment of the method according to the second aspect, the potential or voltage of the data electrodes the preliminary discharge period is set to be approximately equal to the ground level. There is an additional advantage that the voltage values of the first and second preliminary discharge pulses can be lowered.

In a further embodiment of the method according to the second aspect, in the preliminary discharge period, a preliminary-discharge elimination pulse is applied to the row electrodes after the first and second preliminary discharge pulses are applied. The preliminary-discharge elimination pulse has a waveform that varies gradually its voltage value to reach a peak voltage value. The peak voltage value is substantially equal to a potential difference or voltage between the row and column electrodes at a time when the first or second preliminary discharge pulse is applied.

According to a third aspect of the present invention, another method of driving an ac-discharge PDP is provided, in which the PDP has scan electrodes and common electrodes and data electrodes. The common electrodes and the scan electrodes extending parallel to each other, and the data electrode extend perpendicular to the scan and common electrodes, thereby forming pixels arranged in a matrix array.

The method comprises the steps of:

(a) Scan pulses are applied successively to the scan electrodes while data pulses are applied to the data electrodes according to a display signal in a scan period, thereby causing writing discharge.

(b) Sustain pulses are alternately applied to the scan electrodes and the common electrodes in a sustain period subsequent to the scan period, thereby causing sustain discharge for light emission.

When a first one of the sustain pulses is applied to the scan electrodes or the common electrodes in the sustain period, a voltage applied across the scan electrodes and the data electrodes is set to be lower than a voltage applied across the scan electrodes and the common electrodes.

With the method according to the third aspect of the present invention, because of the following reason, sustain discharge of the discharge cells that have emitted light in the previous sub-field at the beginning of the sustain period is always induced, and as a result, the resetting operation of the state of the wall charge or light emission in the previous sub-field is ensured.

In general, discharge starts after the application of a voltage by a specific time lag or delay time, where the time lag varies dependent on the applied voltage. The time lag becomes shorter as the applied voltage increases.

With the method according to the third aspect, when the first one of the sustain pulses is applied to the scan electrodes or the common electrodes in the sustain period, the voltage applied across the scan electrodes and the data electrodes is set to be lower than the voltage applied across the scan electrodes and the common electrodes. Therefore, at the beginning of the sustain discharge, surface discharge can be caused between the scan and common electrodes before opposing discharge occurs between the scan and data electrodes. Thus, sustain discharge surely occurs in the pixels where writing discharge has occurred in the previous sub-field by the first one of the sustain pulses, which means that false emission of light is prevented and at the same time, the resetting operation of the state of the wall charge or light emission in the previous sub-field is carried out.

Moreover, since large driving margin can be set for the scan and sustain voltages or the like, the false emission of light that is induced by the state of emitting light or not in the neighboring pixels, can be prevented even if the scan pulse voltage and/or the sustain pulse voltage fluctuate.

In a preferred embodiment of the method according to the third aspect, the voltage level of the data electrodes is approximately equal to that of the data pulses when the first one of the sustain pulses is applied. The voltage level of the data electrodes is kept at an approximately ground level after the first one of the sustain pulses is applied. Second to last ones of the sustain pulses have positive and negative polarities, and are alternately applied to the scan electrodes and the common electrodes.

In this embodiment, there is an additional advantage that the potential difference or voltage between the scan electrodes and the common electrodes can be set lower than that in the prior-art method of FIGS. 3A to 3E, when the first one of the sustain pulses are applied. Thus, the wall charge over the data electrodes that have been generated by the writing discharge in the scan period can be eliminated, facilitating the sustain discharge by the first one of the sustain pulses.

Also, if the amount of the wall charge over the data electrodes is adjusted to a suitable value in the sustain period, only the wall charges existing over the scan and common electrodes can be adjusted due to discharge in a preliminary discharge period.

Moreover, for example, if the potential of the data electrodes is set as zero (V) at the time when no data pulse is applied, two values of 0 and the data pulse voltage are necessary in the data driver. However, in this case, there is an additional advantage that the PDP can be driven by a two-value driver without any other voltage value or values.

In another preferred embodiment of the method according to the third aspect, the voltage level of the data electrodes is approximately equal to that of the data pulses when the first one of the sustain pulses is applied. The voltage level of the data electrodes is kept at an approximately ground level after the first one of the sustain pulses is applied. The second to last ones of the sustain pulses have a positive polarity only, and are alternately applied to the scan electrodes and the common electrodes.

In this embodiment, there is the same additional advantage as above that the potential difference or voltage between the scan electrodes and the common electrodes can be set lower than that in the prior-art method of FIGS. 3A to 3E, when the first one of the sustain pulses are applied.

In still another preferred embodiment of the method according to the third aspect, the voltage level of the data electrodes is approximately equal to that of a ground level in the whole sustain period. The first one of the sustain pulses has a negative polarity for the scan electrodes and a ground level for the common electrodes. The second to last ones of the sustain pulses have positive and negative polarities, and are alternately applied to the scan electrodes and the common electrodes.

In this embodiment, there is the same additional advantage as above.

In a further preferred embodiment of the method according to the third aspect, the voltage level of the data electrodes is kept approximately equal to that of the data pulses in the whole sustain period. The first one of the sustain pulses has a positive polarity for the scan electrodes and a negative polarity for the common electrodes. The second to last ones of the sustain pulses have a positive polarity, and are alternately applied to the scan electrodes and the common electrodes.

In this embodiment, there is the same additional advantage as above.

In a still further preferred embodiment of the method according to the third aspect, the voltage level of the data electrodes is kept approximately equal to that of a ground level in the whole sustain period. The first one of the sustain pulses has a ground level for the scan electrodes and a negative polarity for the common electrodes. The second to last ones of the sustain pulses have a positive polarity, and are alternately applied to the scan electrodes and the common electrodes.

In this embodiment, there is the same additional advantage as above.

In a still further preferred embodiment of the method according to the third aspect, the voltage level of the data electrodes is approximately equal to that of a ground level when the first one of the sustain pulses is applied, and is kept approximately equal to that of the data electrodes after the first one of the sustain pulses is applied. The first one of the sustain pulses has a ground level for the scan electrodes and a negative polarity for the common electrodes. The second to last ones of the sustain pulses have a positive polarity, and are alternately applied to the scan electrodes and the common electrodes.

In this embodiment, there is the same additional advantage as above.

In a still further preferred embodiment of the method according to the third aspect, the voltage level of the data electrodes is approximately equal to that of a ground level in the whole sustain period. The first one of the sustain pulses has a ground level for the scan electrodes and a negative polarity for the common electrodes. The second to last ones of the sustain pulses have a positive polarity, and are alternately applied to the scan electrodes and the common electrodes.

In this embodiment, there is the same additional advantage as above.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1A:
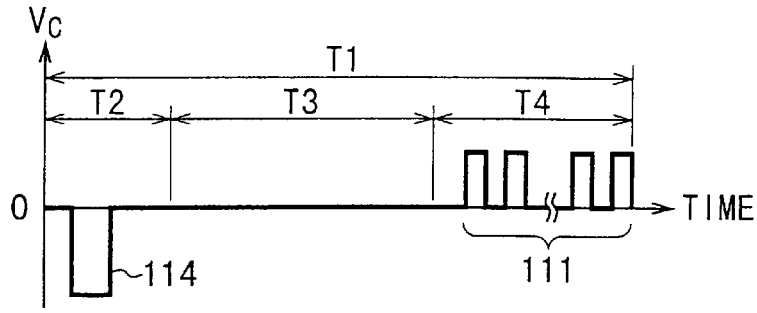
FIG. 1A PRIOR ART
FIGS. 1A to 1E are waveform charts showing a prior-art method of driving an ac-discharge PDP, respectively.
Figure 1B:
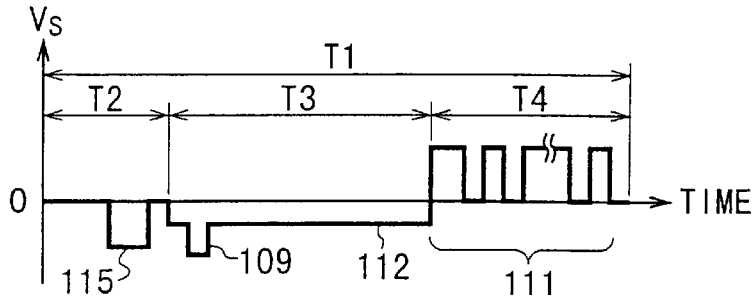
FIG. 1B PRIOR ART
Figure 1C:
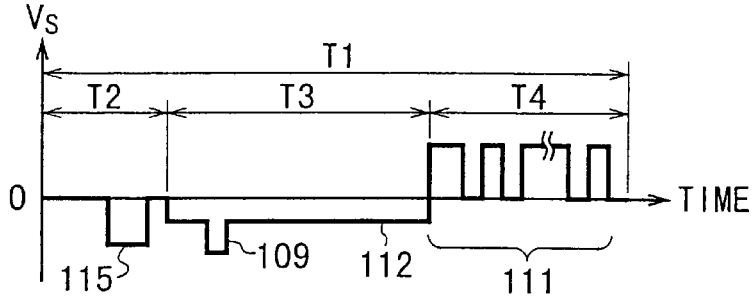
FIG. 1C PRIOR ART
Figure 1D:
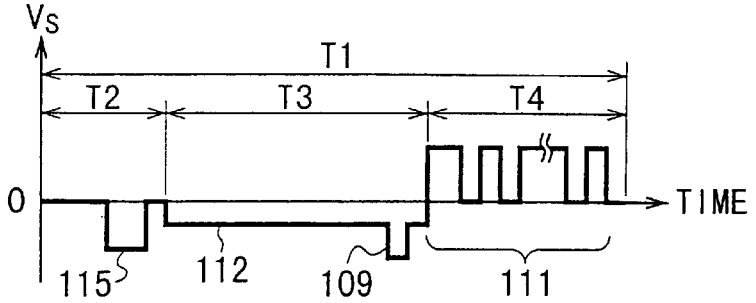
FIG. 1D PRIOR ART
Figure 1E:
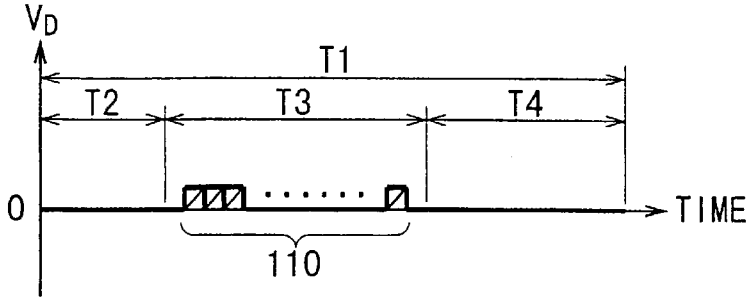
FIG. 1E PRIOR ART
Figure 2A:
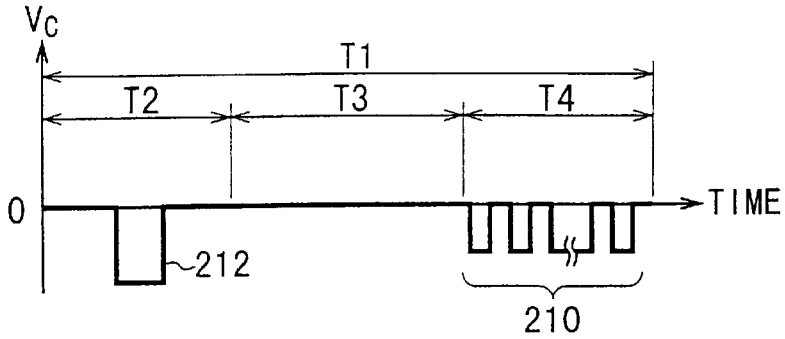
FIG. 2A PRIOR ART
FIGS. 2A to 2E are waveform charts showing another prior-art method of driving an ac-discharge PDP, respectively.
Figure 2B:
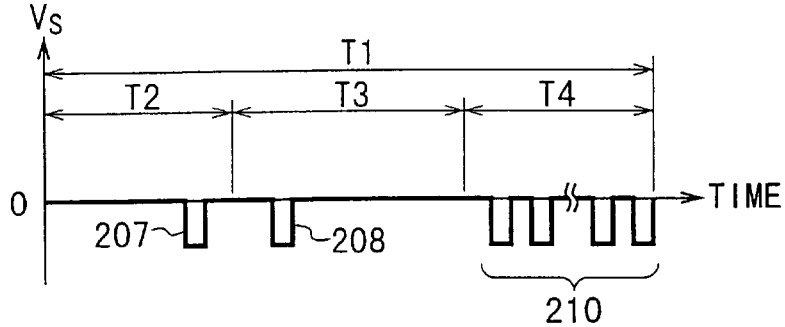
FIG. 2B PRIOR ART
Figure 2C:
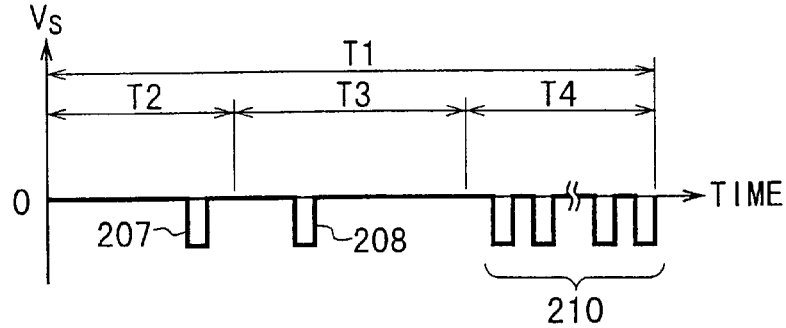
FIG. 2C PRIOR ART
Figure 2D:
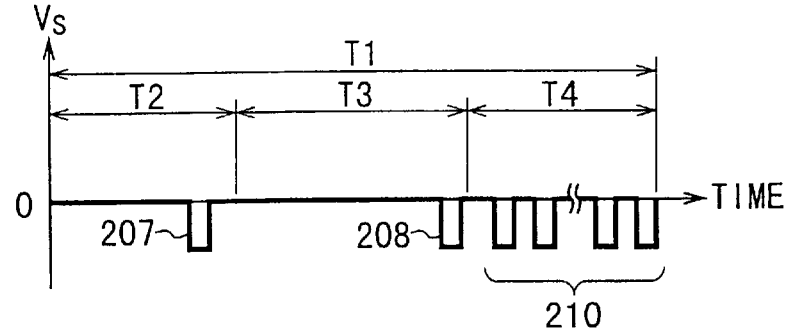
FIG. 2D PRIOR ART
Figure 2E:
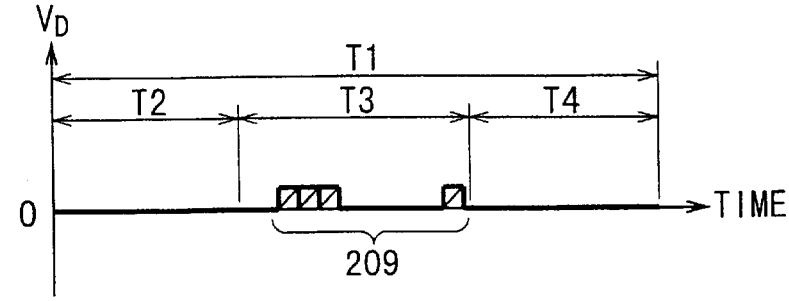
FIG. 2E PRIOR ART
Figure 3A:
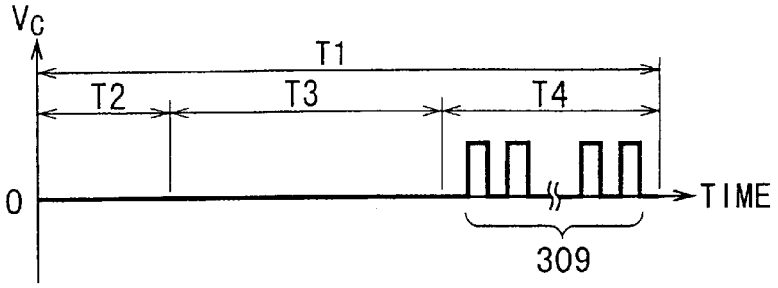
FIG. 3A PRIOR ART
FIGS. 3A to 3E are waveform charts showing a further prior-art method of driving an ac-discharge PDP, respectively.
Figure 3B:
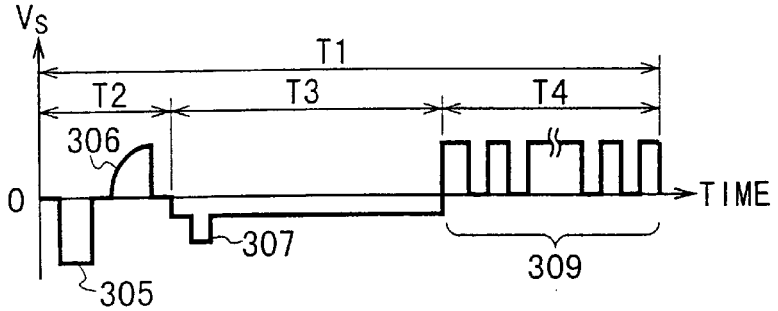
FIG. 3B PRIOR ART
Figure 3C:
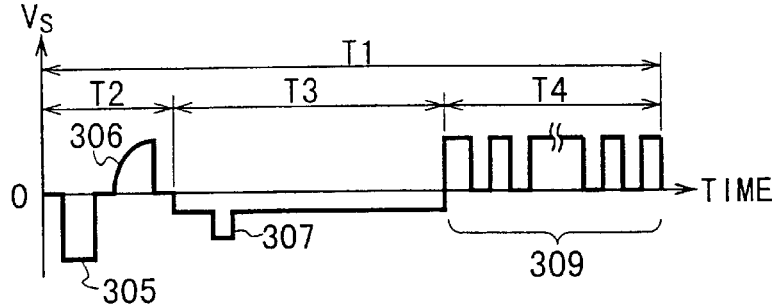
FIG. 3C PRIOR ART
Figure 3D:
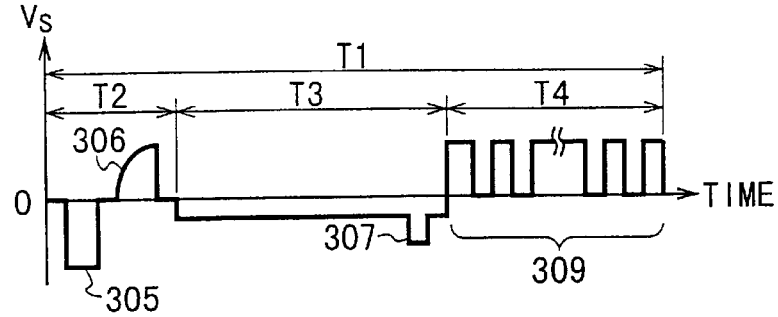
FIG. 3D PRIOR ART
Figure 3E:
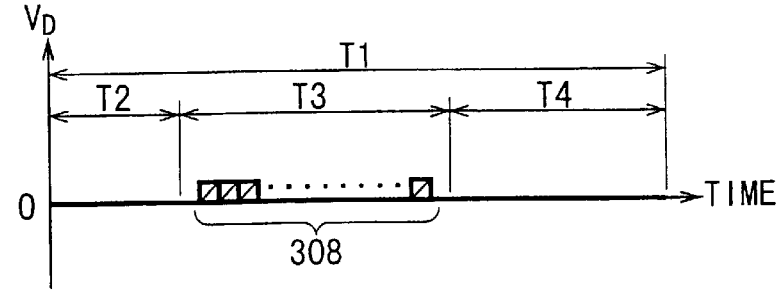
FIG. 3E PRIOR ART

Preferred embodiments of the present invention will be described in detail below while referring to the drawings attached.

First Embodiment

Figure 20:
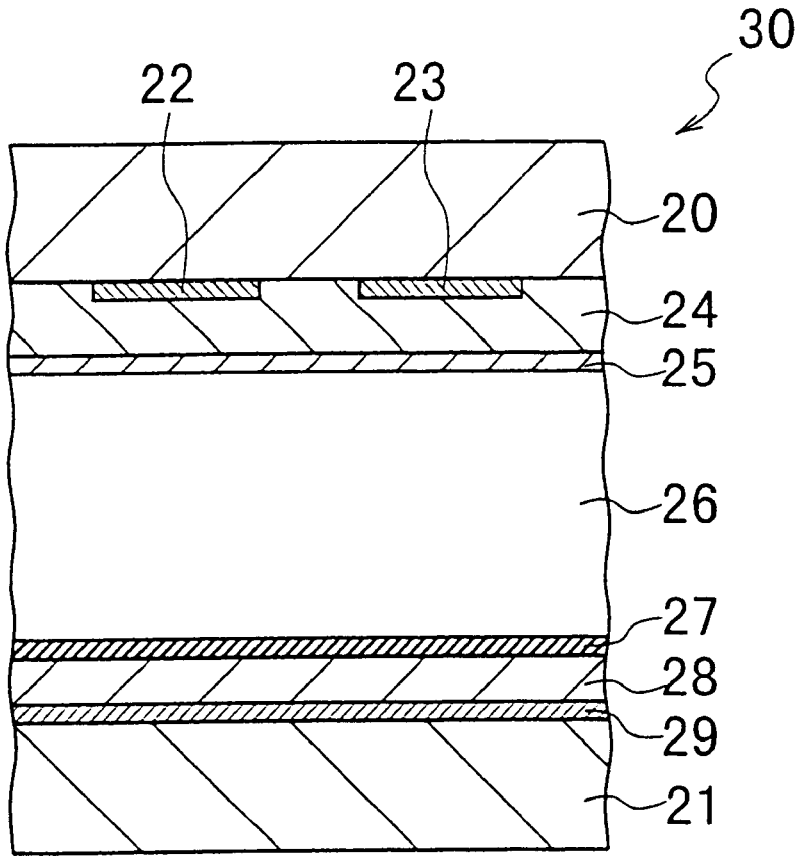
FIG. 20 is a partial, schematic, cross-sectional view of an ac-discharge PDP, which shows the configuration of its discharge cell.
Figure 21:
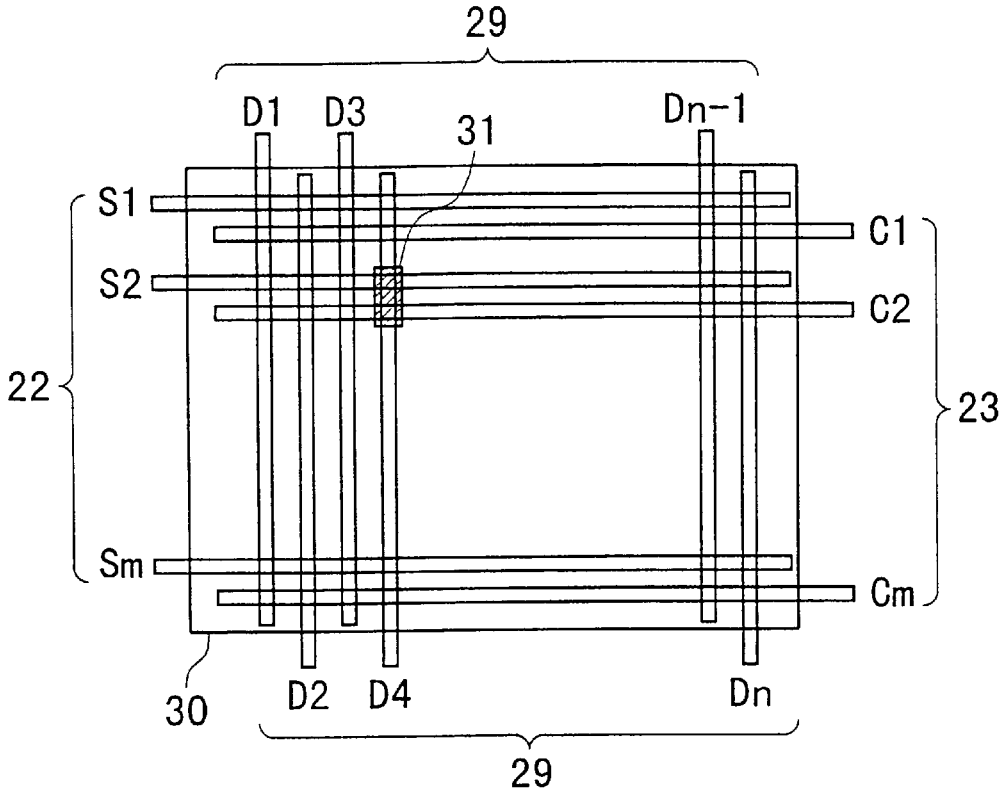
FIG. 21 is a schematic plan view of the ac-discharge PDP shown in FIG. 20.

A method of driving an ac-discharge type PDP according to a first embodiment of the present invention is shown in FIGS. 4A to 4E. In this embodiment and other embodiments explained later, the ac-discharge type PDP has the configuration shown in FIGS. 20 and 21.

As shown in FIGS. 4A to 4E, this driving method includes a sub-field T1 formed by a preliminary discharge period T2, a scan period T3, a sustain period T4, and a conversion period T5. This is different from the prior-art method shown in FIGS. 1A to 1E in that the conversion period T5 is added between the scan and sustain periods T3 and T4.

Figure 4A:
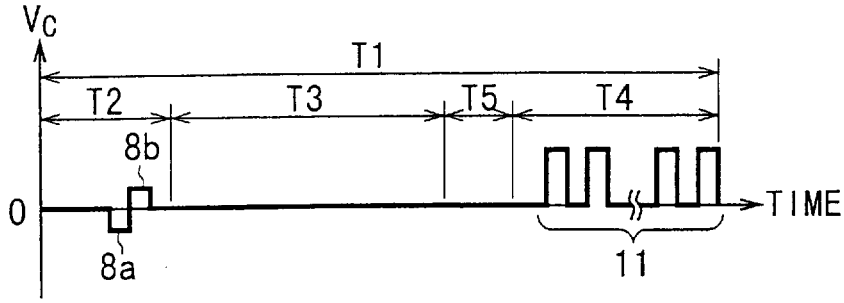
FIGS. 4A to 4E are waveform charts showing a method of driving an ac-discharge PDP according to a first embodiment of the invention, respectively.
Figure 4B:
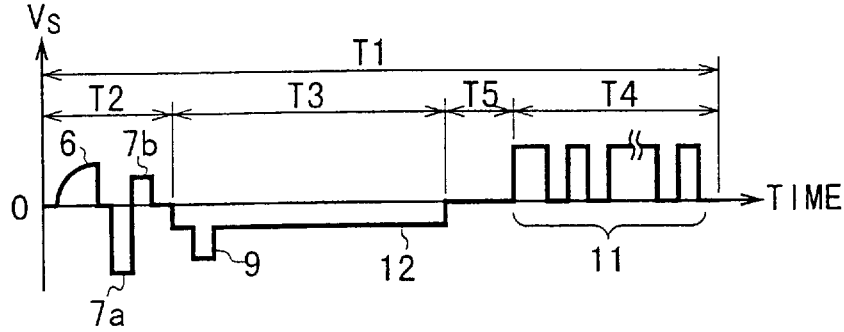
Figure 4C:
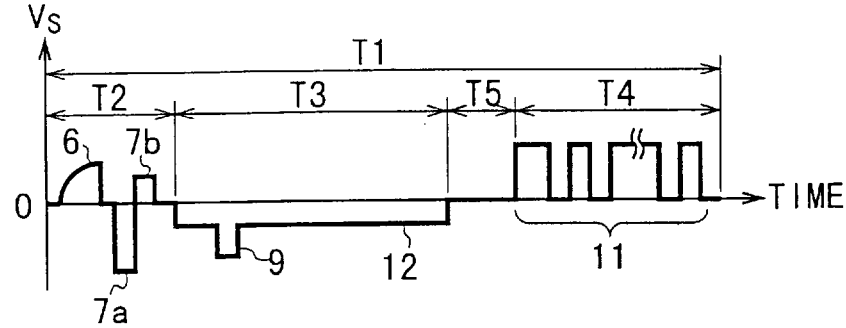
Figure 4D:
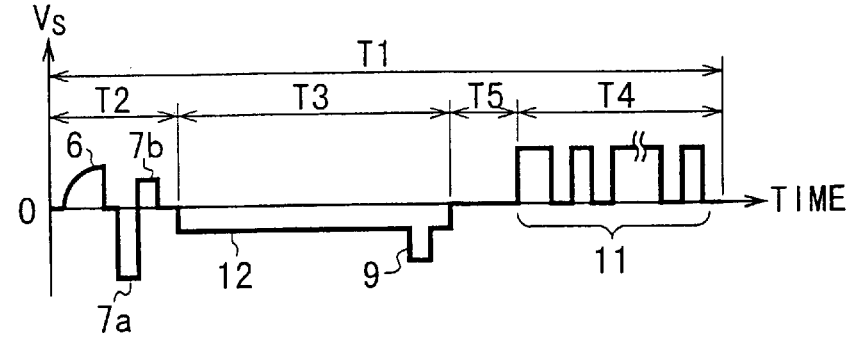
Figure 4E:
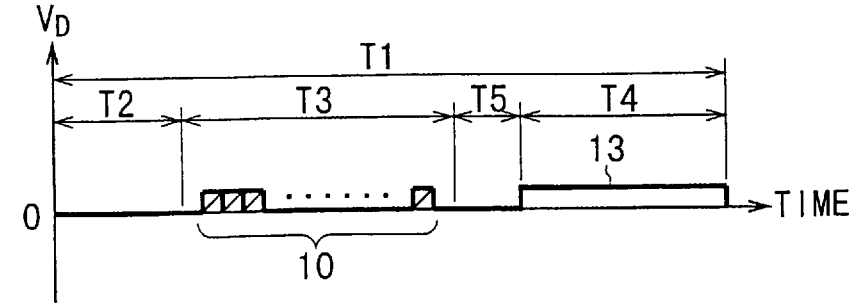

In the preliminary discharge period T2, first, as shown in FIGS. 4B to 4D, a sustain elimination pulse 6 is commonly applied to the scan electrodes 22 (S1 to Sm). Here, as shown in FIGS. 4B to 4D, the pulse 6 has a blunt or dull waveform raising gradually the voltage $V_S$ from zero to a specific positive peak value. Instead of this blunt waveform, a triangular waveform may be applied to the pulse 6 to raise linearly the voltage $V_S$ from zero to the same peak value. The peak or final value of the voltage $V_S$ of the pulse 6 is set as, for example, 160 to 180 V.

Second, a first wall-charge formation pulse 7*a*, which has a rectangular waveform and a negative value, is commonly applied to the scan electrodes 22. At the same timing as that of the pulse 7*a*, as shown in FIG. 4A, a first common bias pulse 8*a*, which has a rectangular waveform and a negative value, is commonly applied to the common electrodes 23 (C1 to Cm). The amplitude of the first common bias pulse 8*a* is smaller than that of the first wall-charge formation pulse 7*a*.

Third, a second wall-charge formation pulse 7*b*, which has a rectangular waveform and a positive value, is commonly applied to the scan electrodes 22. At the same timing as that of the pulse 7*b*, as shown in FIG. 4A, a second common bias pulse 8*b*, which has a rectangular waveform and a positive value, is commonly applied to the common electrodes 23. The amplitude of the second common bias pulse 8*b* is smaller than or approximately equal to that of the second wall-charge formation pulse 7*b*.

For example, the voltage value ($V_S$) of the first wall-charge formation pulse 7*a* is set as −180 to −200 V, and that of the second wall-charge formation pulse 7*b* is set as 100 to 120 V. The voltage value ($V_C$) of the first common bias pulse 8*a* is set as −80 to −110 V, and that of the second common bias pulse 8*b* is set as 80 to 110 V.

Subsequently, in the scan period T3, a scan bias pulse 12, which has a rectangular waveform, is kept to be commonly applied to the scan electrodes 22 for the whole period T3. The voltage value ($V_S$) of the pulse 12 is, for example, −50 to −90 V. Also, scan pulses 9, which have the same rectangular waveform, are successively applied to the scan electrodes 22 from the S1 to Sn to be superposed to the scan bias pulse 12. For example, the voltage value of the scan pulses 9 is set as −170 to −190 V and the pulse width of the same is set as 1.2 to 1.5 $\mu$sec.

Synchronized with the applied scan pulses 9, data pulses 10, which have the same rectangular waveform, are suitably applied to the data electrodes 29 (i.e., D1 to Dn) according to the image signal, respectively. For example, the voltage value ($V_D$) of the data pulses 10 is set as 80 to 90 V.

All of the scan electrodes 22 are scanned, the conversion period T5 begins. In the conversion period T5, all of the scan, common, and data electrodes 22, 23, and 29 are kept at the same ground level, i.e., 0 V.

In the subsequent sustain period T4, rectangular sustain pulses 11 are commonly and successively applied to the common electrodes 23 and the scan electrodes 22. The application timing of the pulses 11 to the common electrodes 23 and to the scan electrodes 22 are different from each other. Specifically, the pulses 11 are alternately applied to these electrode 22 and 23. In other words, when a specific one of the pulses 11 is commonly applied to the scan electrodes 22, it is not applied to the common electrodes 23. In contrast, when a specific one of the pulses 11 is commonly applied to the common electrodes 23, it is not applied to the scan electrodes 22.

As seen from FIGS. 4A to 4D, in the sustain period T4, a first one of the sustain pulses 11 (i.e., the first sustain pulse) is commonly applied to the scan electrodes 22, and a second one of the same (i.e., the second sustain pulse) is commonly applied to the common electrodes 23. A last one of the sustain pulses 11 (i.e., the last sustain pulse) is commonly applied to the common electrodes 23.

The voltage value of the sustain pulses 11 is set as, for example, 160 to 180 V. During the whole sustain period T4, a rectangular data bias pulse 13 is commonly applied to the data electrodes 29. The voltage value of the data bias pulses 13 is set as a half of the voltage value of the sustain pulses 11.

Next, the operation of the PDP caused by the driving method according to the first embodiment is explained below.

First, in the preliminary discharge period T2, the operation is changed according to whether or not the discharge cells 31 have been in the light-emitting state in the preceding, adjoining sub-field T1.

In the cells 31 that have not been in the light-emitting state in the preceding, adjoining sub-field T1, no discharge occurs after the wall charge has been entirely eliminated in the conversion period T5 of the preceding sub-field T1. Thus, just before the time when the sustain elimination pulse 6 is applied in the preliminary discharge period T2 of the present sub-field T1, no wall charge is generated. Accordingly, no discharge occurs even if the sustain elimination pulse 6 is applied to the scan electrodes 22 in this preliminary discharge period T2.

On the other hand, in the cells 31 that have been in the light-emitting state in the preceding, adjoining sub-field T1, some positive charge has been generated in the regions of the dielectric layer 24 over the scan electrodes 22 and some negative charge has been generated in the regions of the layer 24 over the common electrodes 23 by the application of the last sustain pulse 11 in this preceding sub-field T1. Thus, in the preliminary discharge period T2 of the present sub-field T1, weak discharge occurs due to the application of the sustain elimination pulse 6. As the voltage level of the pulse 6 rises with time, the wall charge existing over the scan electrodes 22 and the common electrodes 23 decreases gradually. When the application of the pulse 6 is finished, the existing wall charge is entirely eliminated.

Following this, by commonly applying the first wall-charge formation pulse 7*a* to the scan electrodes 22, opposing discharge is induced between the scanning electrodes 22 and the data electrodes 29. However, at the same timing as the pulse 7*a*, the first common bias pulse 8*a* is commonly applied to the common electrodes 23. Therefore, no surface discharge occurs between the scanning electrodes 22 and the common electrodes 23. As a result, positive charge is induced over the scanning electrodes 22 and negative charge is induced over the data electrodes 29.

Subsequent to the first wall-charge formation pulse 7*a*, the positive, second wall-charge formation pulse 7*b*, which is opposite in polarity to the pulse 7*a*, is commonly applied to the scan electrodes 22. At the same timing as the pulse 7*b*, the positive second common bias pulse 8*b* is commonly applied to the common electrodes 23. Thus, no surface discharge occurs between the scanning electrodes 22 and the common electrodes 23, generating a small amount of negative wall charge over the scanning electrodes 22 and a small amount of positive wall charge over the data electrodes 29.

Next, the scan period T3 begins in the state that a small amount of negative wall charge exists over the scanning electrodes 22 and a small amount of positive wall charge exists over the data electrodes 29. The scan pulses 9 are successively applied to the scan electrodes 22 along with the scan bias pulse 12, which is the same as that of the prior-art method of FIGS. 1A to 1E.

Since the negative wall charge exists over the scan electrodes 22 and positive wall charge exists over the data electrodes 29, the resultant voltage applied across the discharge spaces 26 is greater than the applied voltage by the scan and scan bias pulses 9 and 12 and the data pulses 10, thereby causing opposing discharge between the scan and data electrodes 22 and 29. This opposing discharge occurs independent of whether the data pulse 10 is applied or not, in other words, this opposing discharge occurs in all the cells 31.

In addition to the above-identified resultant voltage applied across the discharge spaces 26, the data pulses 10 are further applied to the corresponding cells 31 according to an image data. Thus, a specific image data is written into the corresponding cells 31 due to the above-identified opposing discharge. This means that the writing discharge is induced by a higher voltage than that in the prior-art method of FIGS. 1A to 1E and therefore, the delay or time lag from the application of the scan and data pulses 9 and 10 to the occurrence of the writing discharge can be shortened. For example, the length of the pulses 9 can be set as 1.2 to 1.5 $\mu$m.

The amount of the wall charge varies dependent on the existence or absence of the data pulses 10. The application of the data pulses 10 increases the amount of the wall charge that is generated by only the scan pulses 9.

In the driving method according to the first embodiment of FIGS. 4A to 4E, the data pulses 10 are not applied to the light-emitting cells 31 while they are applied to the non-light-emitting cells 31. The wall charge induced over the scan electrodes 22 is positive and that over the data electrodes 29 is negative. The scan bias pulse 12 is applied to the scan electrodes 22 so that no opposing discharge occurs due to the wall charge thus induced.

After the scan period T3 is completed, the conversion period T5 starts. In the conversion period T5, all of the electrodes 22, 23, and 29 are kept at the ground potential (i.e., 0 V).

In the non-emitting cells 31, the data pulses 10 have been applied to the data electrodes 29 at the time when the writing discharge has taken place in the scan period T3, and a large quantity of wall charge has been induced. This wall charge disappears due to the opposing discharge in the conversion period T5. This means that even if the sustain pulses 11 are applied to the scan and common electrodes 22 and 23 in the sustain period T4, no sustain discharge will occur and the cells 31 will emit no light.

On the other hand, in the emitting cells 31, since the data pulses 10 have not been applied to the data electrodes 29 at the time the writing discharge has taken place, the amount of induced wall charge in the scan period T3 is small. No discharge occurs in the conversion period T4. Thus, the small amount of wall charge remains unchanged in the conversion period T5. This means that because of the applied sustain pulses 11, sustain discharge will occur and the corresponding cells 31 will emit light.

In the sustain electrodes T4, the voltage of the data electrode 29 is set at the middle level of the voltage of the applied sustain pulses 11. Thus, the wall charge existing over the data electrodes 29 can be entirely eliminated by utilizing the motion of the charged particles induced by the electric field.

As explained above in detail, with the driving method according to the first embodiment of the invention, a small amount of negative wall charge is generated over the scanning electrodes 22 and a small amount of positive wall charge is generated over the data electrodes 29 at the beginning of the scan period T3. Then, in the scan period T3, in addition to the negative and positive wall charges, the scan pulses 9 are successively applied to the scan electrodes 22 along with the scan bias pulse 12 while the data pulses 10 are applied to the corresponding data electrodes 29 to the display signal, thereby causing the writing discharge by a higher voltage than that in the prior-art method of FIGS. 1A to 1E.

Therefore, the time lag from the application of the scan and data pulses 9 and 10 to the occurrence of the writing discharge (i.e., the length of the scan pulses 9) can be shortened. Accordingly, even if the count of the scan lines is doubled with respect to the conventional one (e.g., 480 lines) for the High-Definition TVs (HDTVs), the length of the scan period T3 is kept unchanged. This means that the sustain period T4 needs not to be shortened, and luminance decrease of the display screen can be prevented.

Second Embodiment

FIGS. 5A to 5E show a method of driving an ac-discharge type PDP according to a second embodiment of the invention, which uses the same steps and pulses as those in the method according to the first embodiment of FIGS. 4A to 4E, except that a pair of scan bias pulses 12*a* and 12*b* are used instead of the scan bias pulse 12. Therefore, the explanation about the same steps and pulses is omitted here for the sake of simplification by attaching the same reference symbols as those in FIGS. 4A to 4E to the same elements in FIGS. 5A to 5E.

Figure 5A:
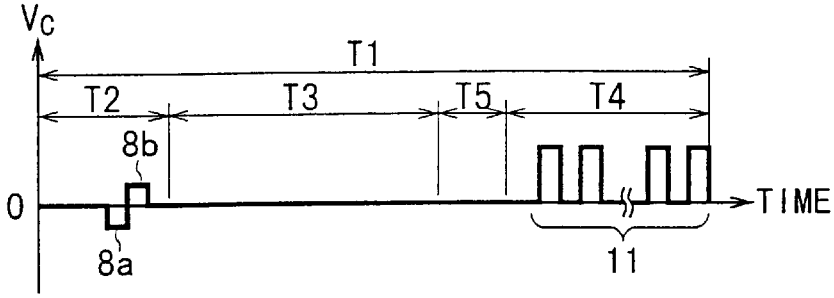
FIGS. 5A to 5E are waveform charts showing a method of driving an ac-discharge PDP according to a second embodiment of the invention, respectively.
Figure 5B:
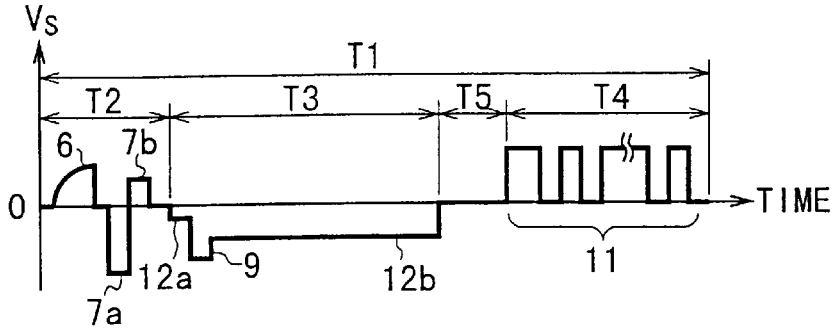
Figure 5C:
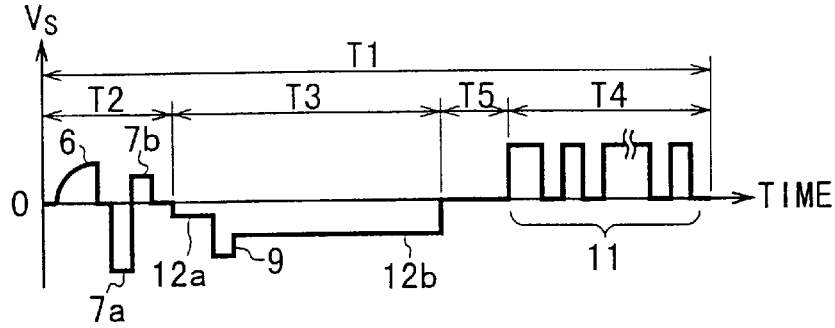
Figure 5D:
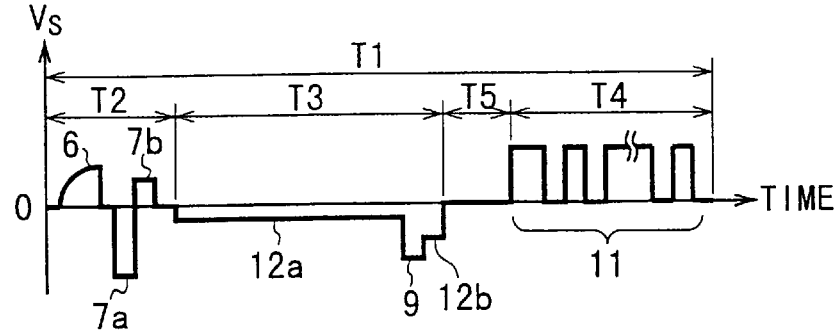
Figure 5E:
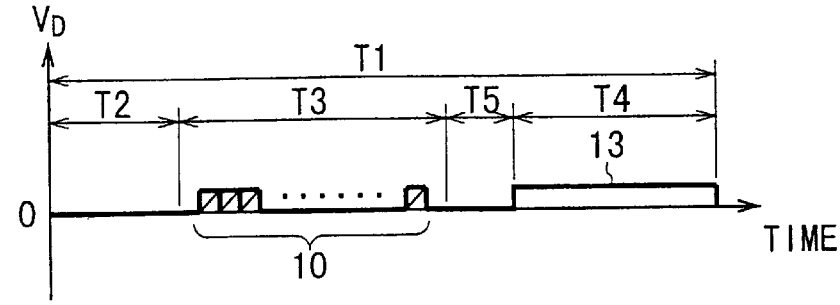
Figure 6A:
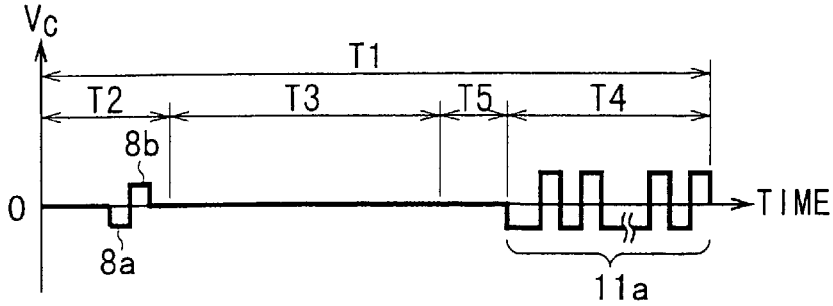
FIGS. 6A to 6E are waveform charts showing a method of driving an ac-discharge PDP according to a third embodiment of the invention, respectively.
Figure 6B:
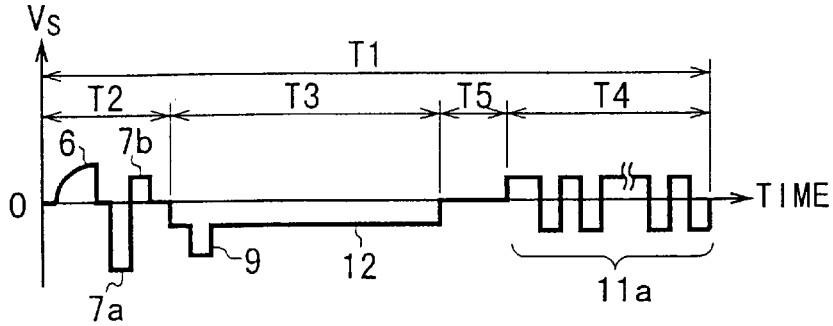
Figure 6C:
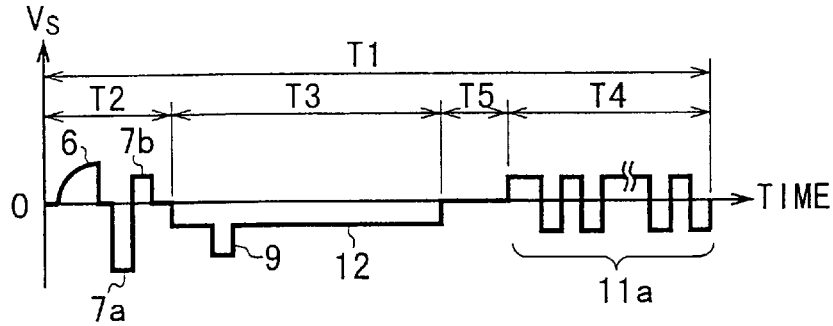
Figure 6D:
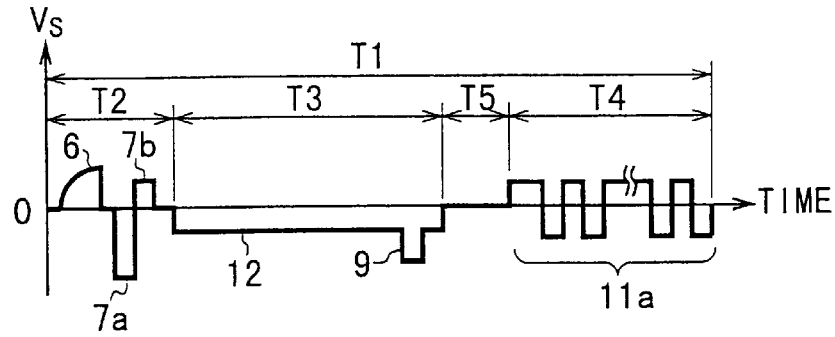
Figure 6E:
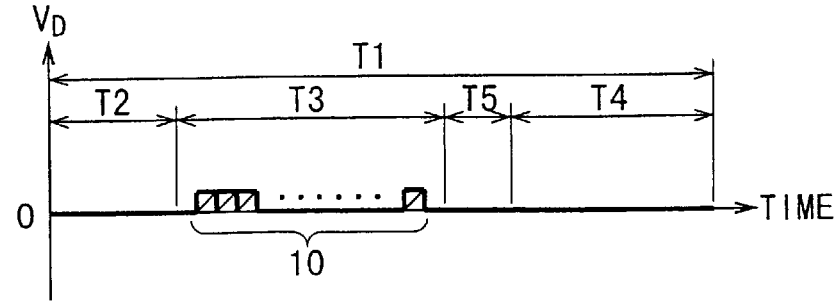

As shown in FIGS. 5B to 5D, the former scan bias pulse 12*a* is successively applied to the scan electrodes 22 before the application of the scan pulses 9, and the latter scan bias pulse 12*b* is successively applied to the scan electrodes 22 after the application of the scan pulses 9. The amplitude or voltage level of the scan bias pulse 12*a* is lower than that of the scan bias pulse 12*b*.

Before the scan pulse 9 is applied to the scan electrodes 22 in the scan period T3, negative wall charge exists over the scan electrodes 22. After the application of the pulse 9, positive wall charge exists over the scan electrodes 22. Thus, using the pulses 12*a* and 12*b* having different voltage levels, there arises an additional advantage that error discharge is difficult to occur both before and after the application of the scan pulse 9.

For example, the voltage levels of the pulses 12*a* and 12*b* may be set as −20 V and −80 V, respectively.

The use of the scan bias pulses 12*a* and 12*b* having different voltage levels can be applied to other embodiments described later.

Third Embodiment

FIGS. 6A to 6E show a method of driving an ac-discharge type PDP according to a third embodiment of the invention, which uses the same steps and pulses as those in the method according to the first embodiment of FIGS. 4A to 4E, except that sustain pulses 11*a* having both the positive and negative polarities is used instead of the sustain pulses 11 with only the positive polarity, and that the data bias pulse 13 is omitted in the sustain period T4. Therefore, the explanation about the same steps and pulses is omitted here for the sake of simplification by attaching the same reference symbols as those in FIGS. 4A to 4E to the same elements in FIGS. 6A to 6E.

As shown in FIGS. 6A to 6D, the value of the sustain pulses 11*a* is changed between positive and negative values. For example, the voltage levels of the sustain pulses 11*a* are set as +80 V and −80 V.

Since the data bias pulse 13 applied to the data electrodes 29 in the sustain period T4 is omitted, the electrodes 29 are kept at the ground level (i.e., 0 V) in the entire period T4.

Fourth Embodiment

FIGS. 7A to 7E show a method of driving an ac-discharge type PDP according to a fourth embodiment of the invention, which uses the same steps and pulses as those in the method according to the first embodiment of FIGS. 4A to 4E, except that the first common bias pulse 8*a* in the preliminary discharge period T2 is omitted, and that a data bias pulse 14 is applied to the data electrodes 29 in the same period T2. Therefore, the explanation about the same steps and pulses is omitted here for the sake of simplification by attaching the same reference symbols as those in FIGS. 4A to 4E to the same elements in FIGS. 7A to 7E.

Figure 7A:
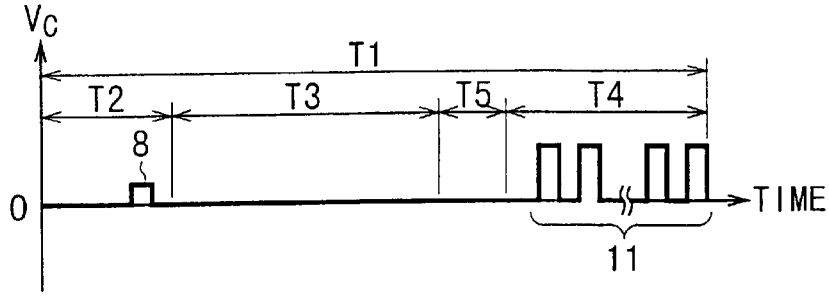
FIGS. 7A to 7E are waveform charts showing a method of driving an ac-discharge PDP according to a fourth-embodiment of the invention, respectively.
Figure 7B:
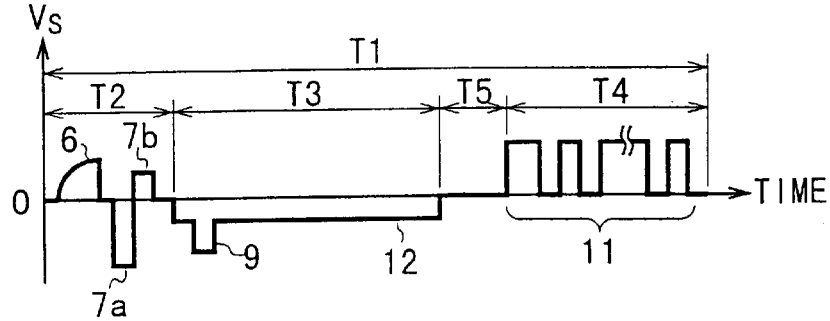
Figure 7C:
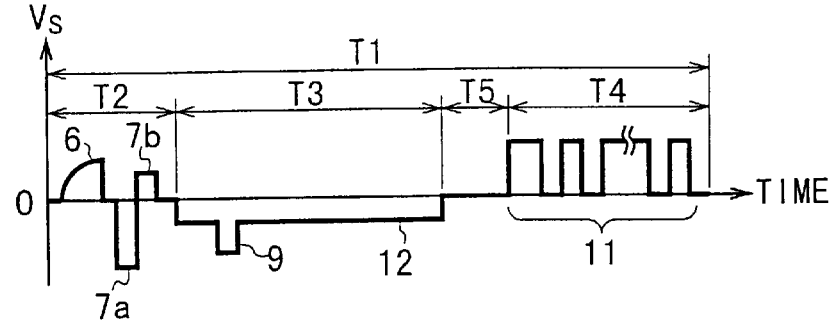
Figure 7D:
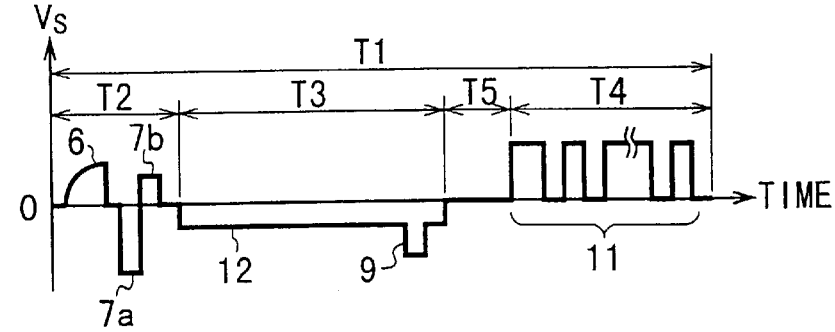
Figure 7E:
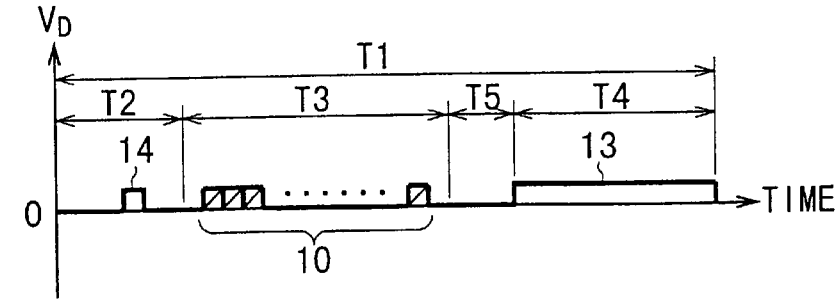

As shown in FIGS. 7A and 7E, in the preliminary discharge period T2, the first common bias pulse 8*a* in the first embodiment is omitted. Therefore, only a common bias pulse 8, which corresponds to the second common bias pulse 8*a*, is applied to the common electrodes 23.

Also, in the preliminary discharge period T2, the data bias pulse 14 is applied to the data electrodes 29 at the same timing as that of the first common bias pulse 8*a* in the first embodiment. The voltage level of the pulse 14 is equal to that of the pulse 8*a*.

There is an additional advantage that only the positive voltages can be applied to the common electrodes 23.

In the above-described first to fourth embodiments, the conversion period T5 begins at the same timing after the scan period T3. In this case, however, there arises a disadvantage that the peak current tends to be large in the PDP itself. To eliminate this disadvantage, as shown in FIG. 22, it is preferred that the scan electrodes 22 are divided into two or more groups and that the start timing of the period T5 for the individual groups is shifted by a specific short period (e.g., several μsec each).

Figure 22:
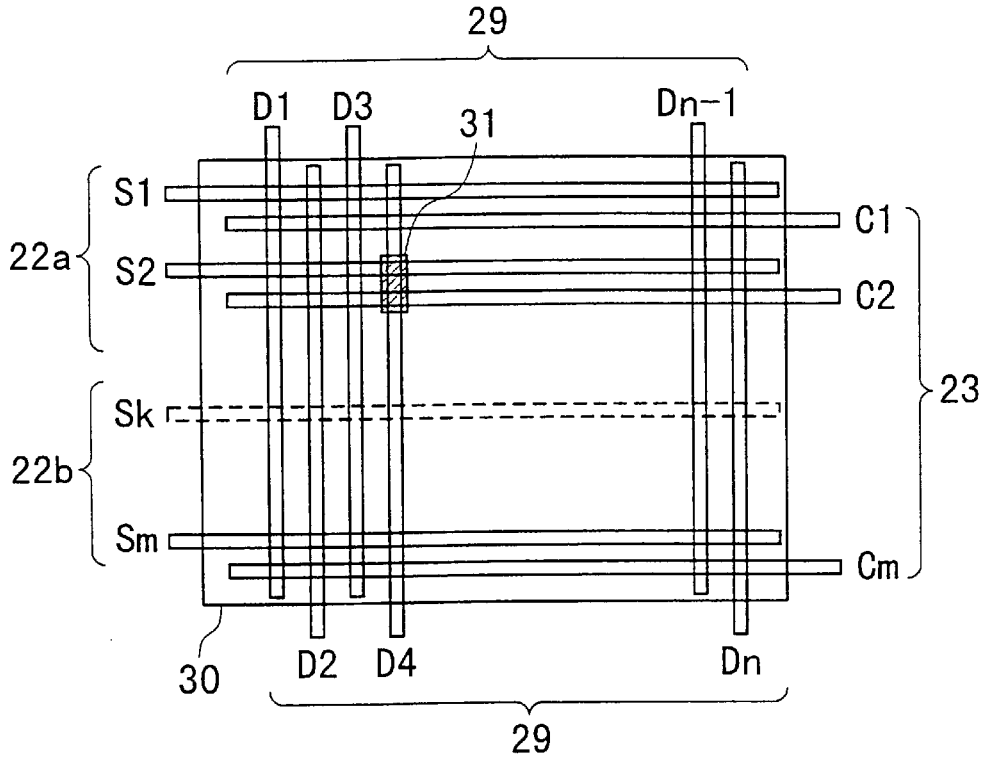
FIG. 22 is a schematic plan view of the ac-discharge PDP shown in FIG. 20, which shows a variation of the first to fourth embodiments.

In FIG. 22, the electrodes 22 are simply divided into two groups 22*a* and 22*b*. However, needless to say, they bay be divided into three or more groups.

Fifth Embodiment

FIGS. 8A to 8E show a method of driving an ac-discharge type PDP according to a fifth embodiment of the invention.

Figure 8A:
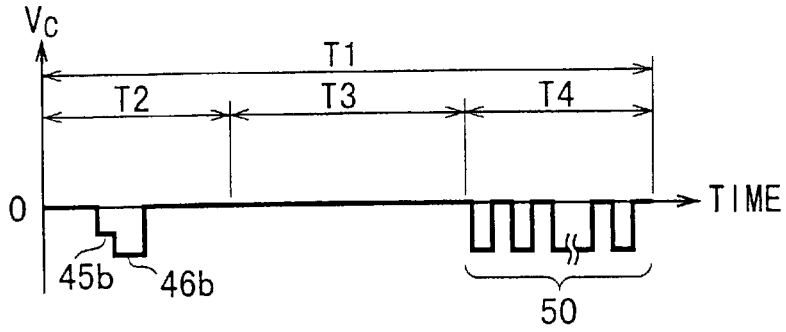
FIGS. 8A to 8E are waveform charts showing a method of driving an ac-discharge PDP according to a fifth embodiment of the invention, respectively.
Figure 8B:
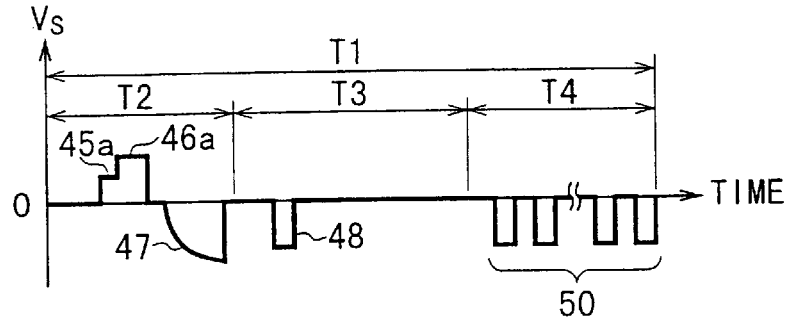
Figure 8C:
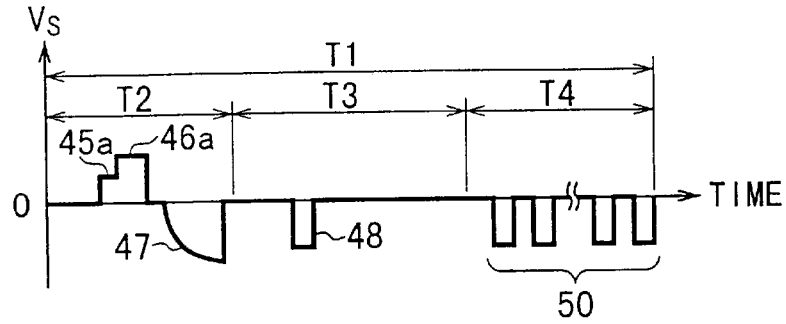
Figure 8D:
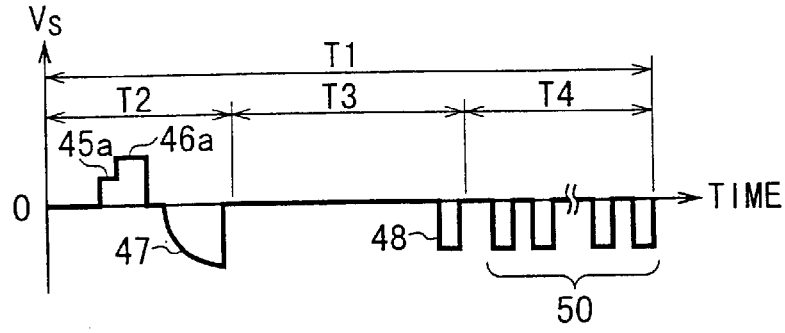

In this method, as shown in FIGS. 8B to 8D, scan pulses 48 are successively applied to the scan electrodes 22 in the scan period T3 while data pulses 49 are applied to the data electrode 29. For example, the voltage level and the width of the scan pulses 48 are −180 to −200 V and 2 to 3 μsec, respectively. The voltage level and the width of the data pulses 49 are, for example, 80 to 90 V and 3 to 4 μsec, respectively.

Sustain pulses 50 are alternately applied to the scan electrodes 22 and the common electrodes 23 in the sustain period T4. For example, the voltage level of the sustain pulses 50 is −160 to −180 V.

The waveforms and timings of the scan, data, and sustain pulses 48, 49, and 50 are the same as those of the pulses 208, 209, and 210 in the prior-art method of FIGS. 2A to 2E, respectively. Thus, the explanation about these pulses 48, 49, and 50 are omitted here.

Unlike the prior-art method of FIGS. 2A to 2E, in the preliminary discharge period T2, a first preliminary discharge pulse 45*a* and a second preliminary discharge pulse 46*a* are commonly applied to the scan electrodes 22, and a first preliminary discharge pulse 45*b* and a second preliminary discharge pulse 46*b* are commonly applied to the common electrodes 23. The first and second preliminary discharge pulses 45*a* and 46*a* are of the positive polarity, and the first and second preliminary discharge pulses 45*b* and 46*b* are of the negative polarity. The first pulse 45*a* is equal in voltage level (i.e., amplitude), pulse width, and application timing to those of the first pulse 45*b*. The second pulse 46*a* is equal in voltage level, pulse width, and application timing to those of the second pulse 46*b*. Thus, the potential difference or voltage between the scan electrodes 22 and the common electrodes 23 in the preliminary discharge period T2 is kept in opposite polarity to that generated by the last one of the sustain pulses 50 applied to the scan electrodes 22 in the sustain period T4.

The voltage levels of the first preliminary discharge pulses 45*a* and 45*b* are set as 80 to 90 V, which is approximately equal to half of the voltage level (i.e., 160 to 180 V) of the sustain pulses 10. The voltage levels of the second preliminary discharge pulses 46*a* and 46*b* are set as 160 to 180 V, which is approximately equal to the voltage level of the sustain pulses 50. The pulse widths of the pulses 45*a*, 45*b*, 46*a*, and 46*b* are set to be values within 3 to 5 μsec.

After a specific period passes from the start of the preliminary discharge period T2, the first and second preliminary discharge pulses 45*a* and 46*a* are commonly applied to the scan electrodes 22 without any time lag. Synchronized with the pulses 45*a* and 46*a*, the first and second preliminary discharge pulses 45*b* and 46*b* are commonly applied to the common electrodes 23.

Then, after the scan and common electrodes 22 and 23 are set as the ground level for a while, a preliminary discharge elimination pulse 47 is commonly applied to the scan electrodes 22. The pulse 47 has a blunt or dull waveform lowering gradually the voltage $V_S$ from zero to a specific negative peak value, which is produced by using a capacitor (s) and a resistor(s). The pulse width of the pulse 47 is 80 to 150 μsec and the peak voltage thereof is −180 to −210 V.

Figure 8E:
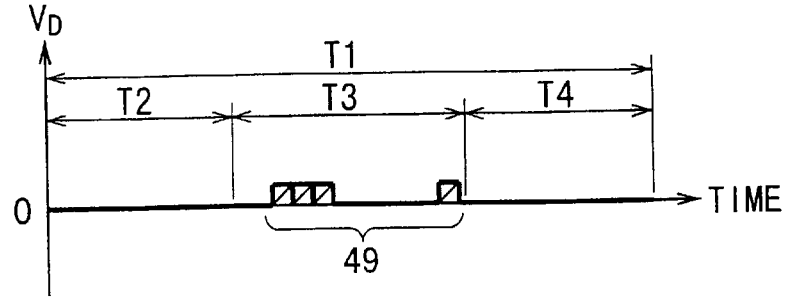

The data electrodes 29 are kept at the ground level in the entire preliminary discharge period T2, as seen from FIG. 8E.

Next, the operation of the PDP caused by the driving method according to the fifth embodiment is explained below.

In the discharge cell 31 that has not emitted light in the prior, adjoining sub-field T1, almost no wall charge has been generated, because no discharge has occurred during the prior sub-field T1. In this case, if the first preliminary discharge pulses 45*a* and 45*b* are applied to the scan and common electrodes 22 and 23, respectively, the potential difference or voltage between these electrodes 22 and 23 is almost equal to twice (i.e., 160 to 180 V) the voltage level of the pulses 45*a* and 45*b*. Since the discharge starting voltage is approximately equal to 200 V, no discharge occurs in this state.

Subsequently, the second preliminary discharge pulses 46*a* and 46*b* are applied to the scan and common electrodes 22 and 23, respectively. In this state, the potential difference between these electrodes 22 and 23 is almost equal to twice (i.e., 320 to 360 V) the voltage level of the pulses 46*a* and 46*b* and therefore, strong discharge occurs. Thus, the number of the charged particles in the cells 31 increases to thereby lower the discharge starting voltage in the subsequent scan period T3. At this time, the potential of the data electrodes 29 are set to be the ground, as shown in FIG. 8E. This is to set the potential level of the data electrodes 29 at the middle point of the potential difference between the scan and common electrodes 22 and 23.

As a result, almost no wall charge is generated over the data electrodes 29, even if opposing discharge occurs between the data electrodes 29 and the scan or common electrodes 22 or 23, or attachment of the charged particles occurs due to surface discharge caused between the scan and common electrodes 22 and 23. This means that it is sufficient for the subsequent preliminary discharge elimination pulse 47 to eliminate only the wall charge existing over the scan and common electrodes 22 and 23, facilitating the discharge elimination. Thus, the discharge elimination can be achieved by only one preliminary discharge elimination pulse 47, which means that and two or more preliminary discharge elimination pulses 47 are unnecessary.

On the other hand, due to the above strong discharge between the scan and common electrodes 22 and 23, a large amount of negative wall charge is generated over the scan electrodes 22 and at the same time, a large amount of positive wall charge is generated over the common electrodes 23. Part of these wall charge is automatically eliminated by self-erasing discharge induced at the fall time of the preliminary discharge pulses 46*a* and 46*b*. The self-erasing discharge is induced by the opposite-polarity potential difference generated between the scan and common electrodes 22 and 23 due to the decreasing voltage of the preliminary discharge pulses 46*a* and 46*b*.

Thereafter, to further decrease the existing wall charge, the preliminary-discharge elimination pulse 47 is commonly applied to the scan electrodes 22. In the fifth embodiment of FIGS. 8A to 8E, the pulse 47 has a blunt or dull waveform that lowers gradually the voltage $V_S$ from zero to a specific negative peak value and therefore, weak discharge occurs continuously and the wall charge gradually decreases. The wall charge is entirely eliminated at the end of the pulse 47.

Next, the operation in the cell 31 that has emitted light in the prior, adjoining sub-field T1 is explained below.

In this case, the last one of the sustain pulses 50 (i.e., the last sustain pulse) applied in the prior sustain period T4, which is negative, is commonly applied to the scan electrodes 22. Thus, due to the discharge induced by the last sustain pulse 50, positive wall charge has been generated over the scan electrodes 22 and negative wall charge has been generated over the common electrodes 23. Also, since the data electrodes 29 are connected to the ground at this stage, negative wall charge has been generated over the data electrodes 29. Because of existence of these wall charge, the total potential difference or voltage of approximately 160 to 180 V has been generated in the dielectric layer 24 covering the scan and common electrodes 22 and 23.

Then, if the first preliminary discharge pulses 45*a* and 45*b* are respectively applied to the scan and common electrodes 22 and 23 in the preliminary discharge period T2, the voltage by the pulses 45*a* and 45*b* is superposed the potential difference or voltage of approximately 160 to 180 V, resulting in the total potential difference or voltage of approximately 320 to 360 V between the scan and common electrodes 22 and 23. Thus, strong discharge occurs similar to the cell 31 that has not emitted light in the prior, adjoining sub-field T1.

As a result, almost the same priming effect as caused in the case where the cells 31 have not emitted light can be given. This means that the discharge starting voltage in the scan period T3 can be equalized to each other independent of whether the cells 31 have emitted light or not in the prior sustain period T4. This solves the problem that the cells 31 emit light in error, and vice versa.

At this time, similar to the case where the cells 31 have emitted no light, the potential of the data electrodes 29 are set as the ground level to set the potential level of the data electrodes 29 at the middle point of the potential difference between the scan and common electrodes 22 and 23. Additionally, the discharge elimination is facilitated and thus, the discharge elimination can be achieved by only one preliminary discharge elimination pulse 47.

As explained above, with the method according to the fifth embodiment of FIGS. 8A to 8E, the state of the wall charge that has been generated in the prior sub-field T1 can be reset by a small number of pulses and at the same time, almost the same priming effect can be given independent of whether the cells 31 have emitted light or not in the prior sustain period T4. Accordingly, the problem that the cells 31 emit light or not in error can be solved and the PDP can be operated stably.

In the fifth embodiment explained here, the last sustain pulse 50 of the negative polarity is commonly applied to the scan electrodes 22, as seen from FIGS. 8B to 8D. However, if the last sustain pulse 50 of the negative polarity is commonly applied to the common electrodes 22, the same advantage is obtained. In this case, the waveform of the first and second preliminary discharge pulses 45*a* and 46*a* needs to be replaced with that of the first and second preliminary discharge pulses 45*b* and 46*b*. This is applicable to the following sixth to ninth embodiments.

Sixth Embodiment

FIGS. 9A to 9E show a method of driving an ac-discharge type PDP according to a sixth embodiment of the invention, which uses the same steps and pulses as those in the method according to the fifth embodiment of FIGS. 8A to 8E, except that a triangular preliminary discharge elimination pulse 47*a* is used instead of the dull pulse 47. Therefore, the explanation about the same steps and pulses is omitted here for the sake of simplification by attaching the same reference symbols as those in FIGS. 8A to 8E to the same elements in FIGS. 9A to 9E.

Needless to say, there are the same advantages as those in the fifth embodiment.

Figure 9A:
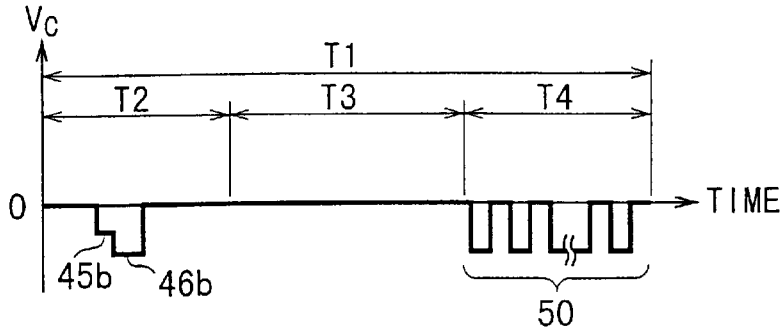
FIGS. 9A to 9E are waveform charts showing a method of driving an ac-discharge PDP according to a sixth embodiment of the invention, respectively.
Figure 9B:
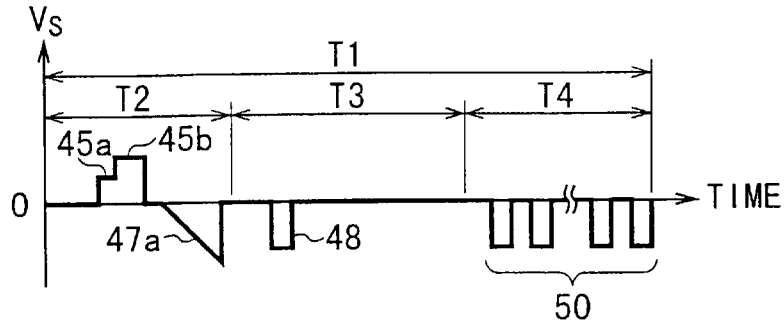
Figure 9C:
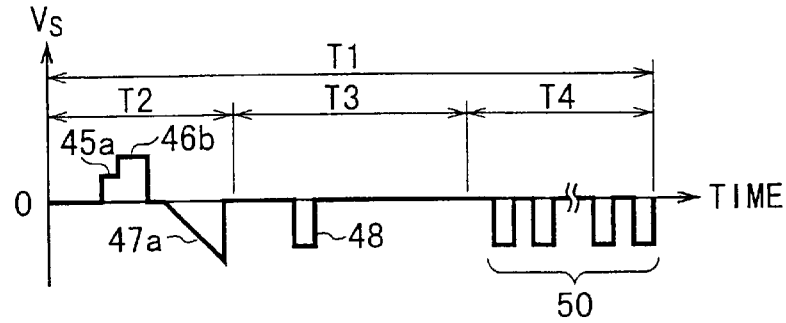
Figure 9D:
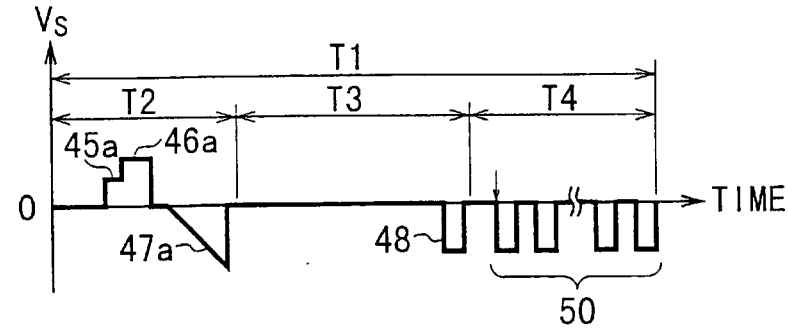
Figure 9E:
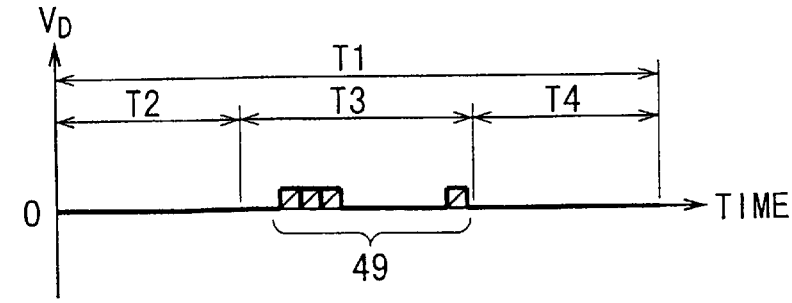

As shown in FIGS. 9A and 9E, the preliminary discharge elimination pulse 47*a* has a triangular or saw-tooth waveform. Because of this waveform, the abrupt voltage rise at the rising time of the pulse 7 in the fifth embodiment can be canceled. Thus, there is an additional advantage that the problem of the false light emission can be prevented from occurring at this rising time.

Seventh Embodiment

FIGS. 10A to 10E show a method of driving an ac-discharge type PDP according to a seventh embodiment of the invention, which uses the same steps and pulses as, those in the method according to the fifth embodiment of FIGS. 8A to 8E, except that different pulses 45*c*, 46*c*, and 46*d* are used in the preliminary discharge period T2 instead of the pulses 45*a*, 45*b*, 46*a*, and 46*b*. Therefore, the explanation about the same steps and pulses is omitted here for the sake of simplification by attaching the same reference symbols as those in FIGS. 8A to 8E to the same elements in FIGS. 10A to 10E.

The scan pulse 48 in the scan period T3 has a voltage value of −180 to −200 V and a pulse width of 2 to 32 μsec. The data pulse 49 in the scan period T3 has a voltage value of 70 to 90 V and a pulse width of 3 to 4 μsec. The sustain pulse 50 in the sustain period T4 has a voltage value of −160 to −180 V.

As shown in FIGS. 10A to 10E, the negative last sustain pulse 50 is commonly applied to the scan electrodes 22 in the sustain period T4.

In the preliminary discharge period T2, a first preliminary discharge pulse 45*c* of the positive polarity is commonly applied to the scan electrodes 22 and then, a second preliminary discharge pulse 46*c* of the positive polarity is commonly applied to the same electrodes 22 without any time lag. Unlike the fifth embodiment of FIGS. 8A to 8E, the voltage level of the pulses 45*c* and 46*c* are equal to each other, which is set as 160 to 180 V. The pulses 45*c* and 46*c* have equal pulse widths of 3 to 5 μsec.

A second preliminary discharge pulse 46*d*, which is opposite in polarity to the pulse 46*c*, is commonly applied to the common electrodes 23 synchronized with the second preliminary discharge pulse 46*c*. The voltage level of the pulse 46*d* is equal to that of the second preliminary discharge pulse 46*c*.

Figure 10A:
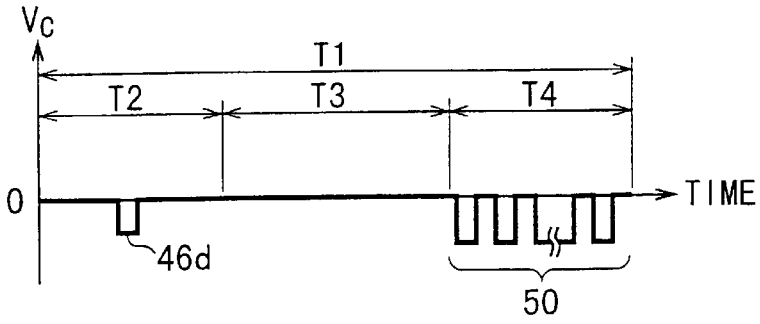
FIGS. 10A to 10E are waveform charts showing a method of driving an ac-discharge PDP according to a seventh embodiment of the invention, respectively.
Figure 10B:
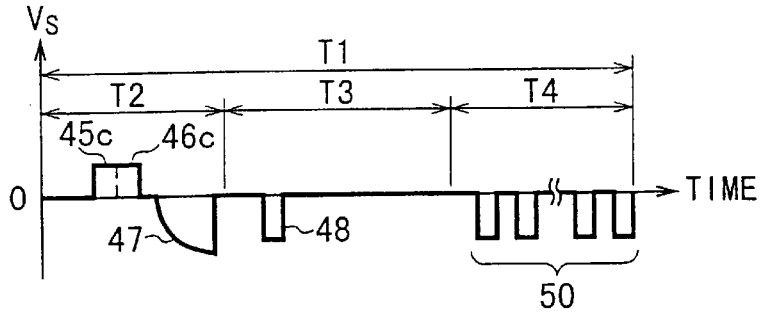
Figure 10C:
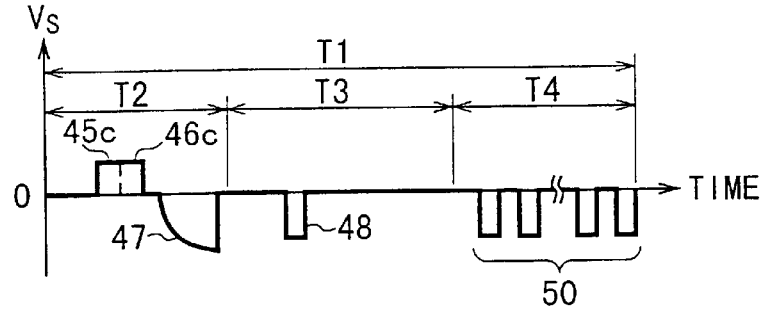
Figure 10D:
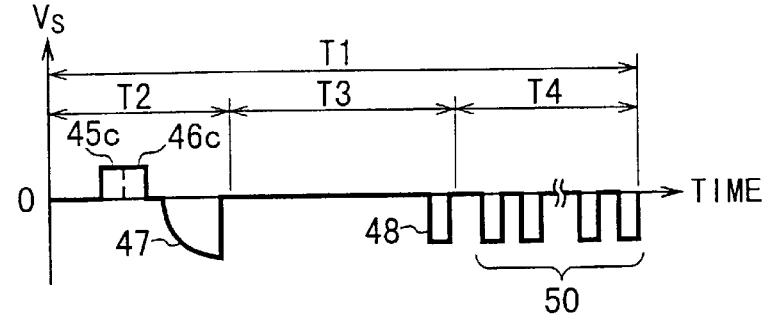
Figure 10E:
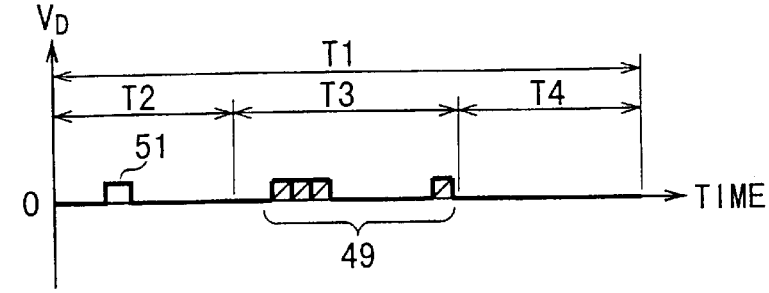

A first preliminary discharge pulse for the common electrodes 23 is not used in this embodiment. Instead of this pulse, as shown in FIG. 10E, a data bias pulse 51 of the positive polarity is commonly applied to the data electrodes 51 synchronized with the first preliminary discharge pulse 45*c* for the scan electrodes 22. The voltage level of the pulse 51 is equal to that of the data pulses 49.

Then, after the scan and common electrodes 22 and 23 are set as the ground level for a while, the preliminary discharge elimination pulse 47 is commonly applied to the scan electrodes 22. The pulse 47 has the same blunt or dull waveform as used in the fifth embodiment of FIGS. 8A to 8E.

A triangular pulse as shown in FIGS. 9A to 9D may be used instead of the dull pulse 47.

Needless to say, the method of the seventh embodiment has the same advantages as those in the fifth embodiment.

Eighth Embodiment

FIGS. 11A to 11E show a method of driving an ac-discharge type PDP according to an eighth embodiment of the invention, which uses the same steps and pulses as those in the method according to the fifth embodiment of FIGS. 8A to 8E, except that different pulses 45*e*, 45*f*, 46*e*, and 46*f* are used in the preliminary discharge period T2 instead of the pulses 45*a*, 45*b*, 46*a*, and 46*b*. Therefore, the explanation about the same steps and pulses is omitted here for the sake of simplification by attaching the same reference symbols as those in FIGS. 8A to 8E to the same elements in FIGS. 11A to 11E.

Figure 11A:
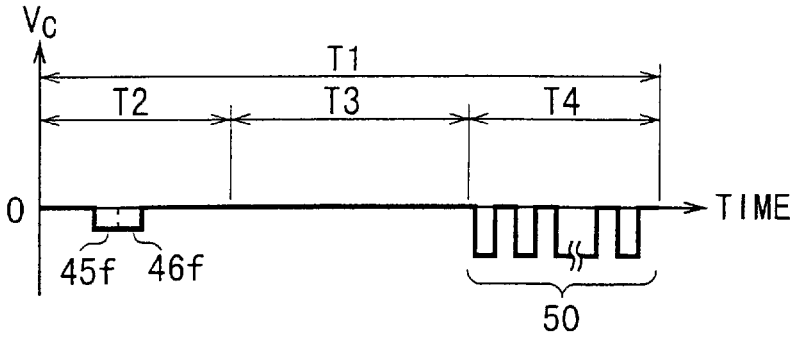
FIGS. 11A to 11E are waveform charts showing a method of driving an ac-discharge PDP according to an eighth embodiment of the invention, respectively.
Figure 11B:
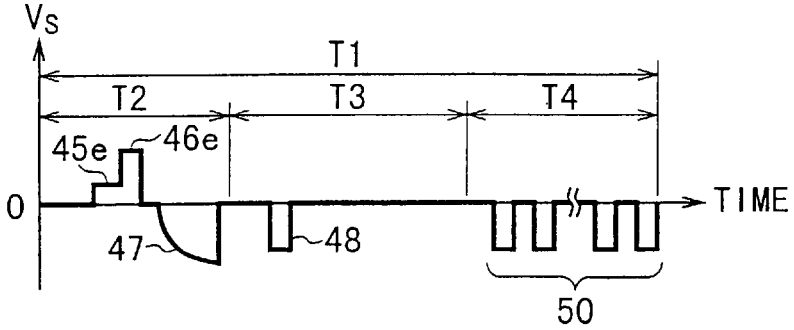
Figure 11C:
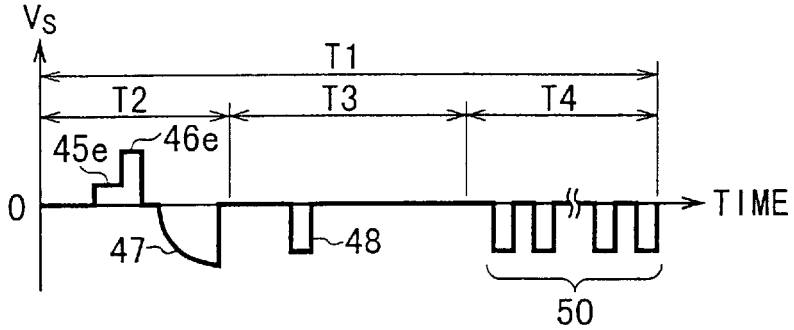
Figure 11D:
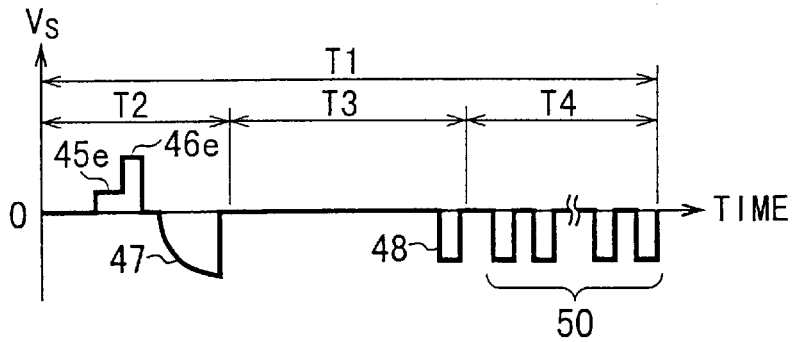
Figure 11E:
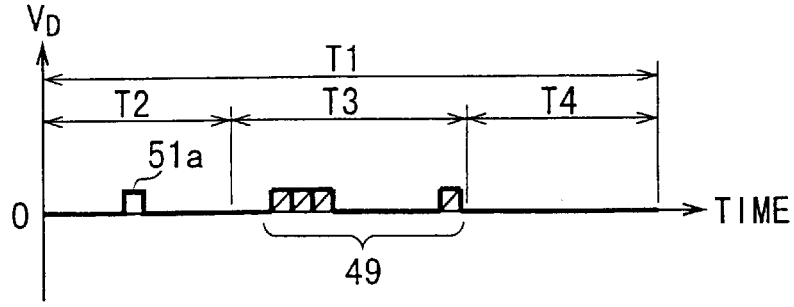

As shown in FIGS. 11A and 11E, in the preliminary discharge period T2, a first preliminary discharge pulse 45*e* is commonly applied to the scan electrodes 22 and then, a second preliminary discharge pulse 46*e* is commonly applied to the scan electrodes 22. The pulses 45*e* and 46*e* are of the positive polarity, which is the same as that of the pulses 45*a* and 46*a* used in the fifth embodiment of FIGS. 8A to 8E.

A first preliminary discharge pulse 45*f* is commonly applied to the common electrodes 23 synchronized with the pulse 45*e* and then, a second preliminary discharge pulse 46*f* is commonly applied to the common electrodes 23 synchronized with the pulse 46*e*. The pulses 45*f* and 46*f* are of the negative polarity, which is the same as that of the pulses 45*a* and 46*a* used in the fifth embodiment.

Thus, the potential difference or voltage between the scan and common electrodes 22 and 23 has an opposite polarity to that at the time when the last sustain pulse 50 is applied to the scan electrodes 22.

The voltage level of the positive first preliminary discharge pulse 45*e* is equal to half (80 to 90 V) of the voltage level of the sustain pulses 50. The voltage level of the negative first preliminary discharge pulse 45*f* is equal to half (−80 to −90 V) of the voltage level of the sustain pulses 50. The voltage level of the positive second preliminary discharge pulse 46*e* is equal to three-seconds (3/2) (240 to 270 V) of the voltage level of the sustain pulses 50. The voltage level of the negative second preliminary discharge pulse 46*f* is equal to that of the pulse 46*e*. The pulse width of these pulses 45*e*, 46*e*, 45*f*, and 46*f* are equal to be 3 to 5 μsec.

Additionally, a data bias pulse 51*a* of the positive polarity is commonly applied to the data electrodes 11 synchronized with the second preliminary discharge pulses 46*e* and 46*f*. The voltage level of the pulse 51 is equal to that of the data pulses 49.

Needless to say, the method of the eighth embodiment has the same advantages as those in the fifth embodiment.

Ninth Embodiment

FIGS. 12A to 12E show a method of driving an ac-discharge type PDP according to a ninth embodiment of the invention, which uses the same steps and pulses as those in the method according to the fifth embodiment of FIGS. 8A to 8E, except that different pulses 45*g*, 45*g*, 46*h*, and 46*h* are used in the preliminary discharge period T2 instead of the pulses 45*a*, 45*b*, 46*a*, and 46*b*. Therefore, the explanation about the same steps and pulses is omitted here for the sake of simplification by attaching the same reference symbols as those in FIGS. 8A to 8E to the same elements in FIGS. 12A to 12E.

Figure 12A:
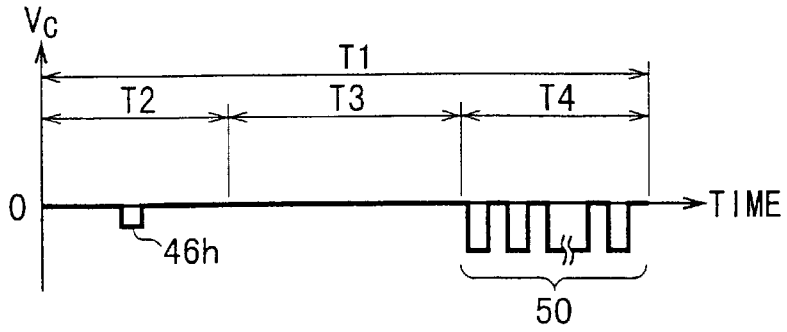
FIGS. 12A to 12E are waveform charts showing a method of driving an ac-discharge PDP according to a ninth embodiment of the invention, respectively.
Figure 12B:
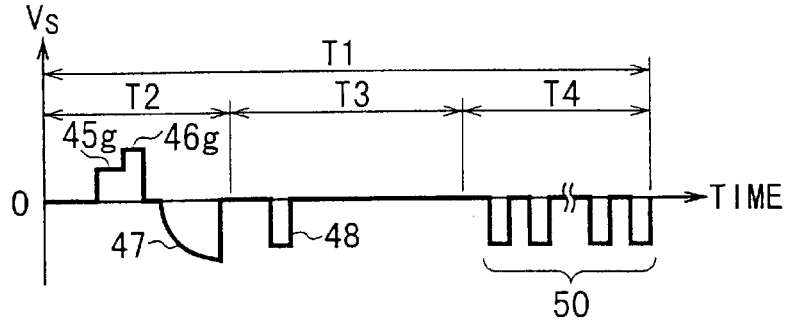
Figure 12C:
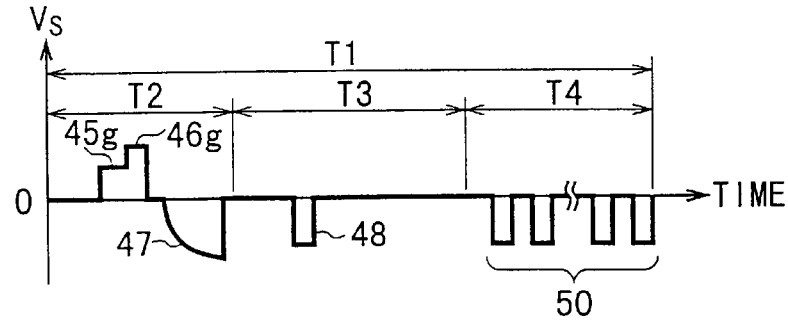
Figure 12D:
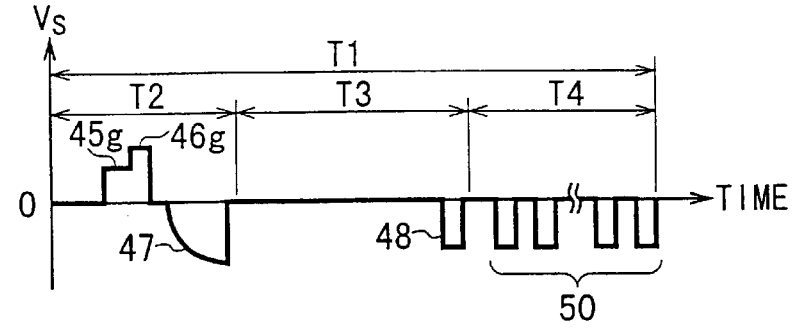
Figure 12E:
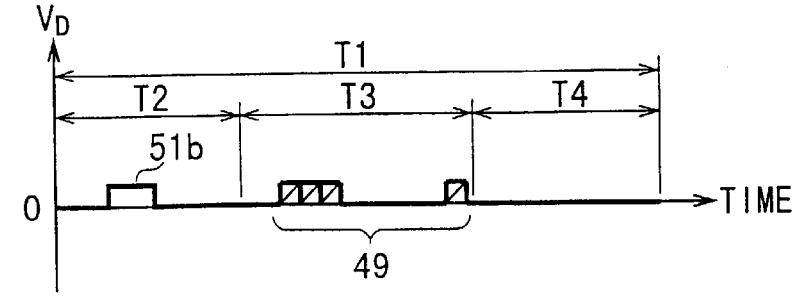
Figure 13A:
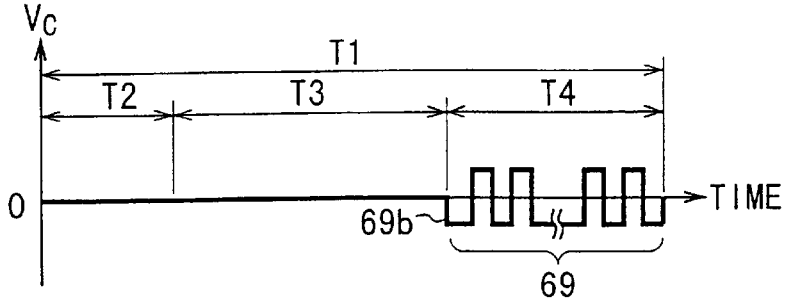
FIGS. 13A to 13E are waveform charts showing a method of driving an ac-discharge PDP according to a tenth embodiment of the invention, respectively.
Figure 13B:
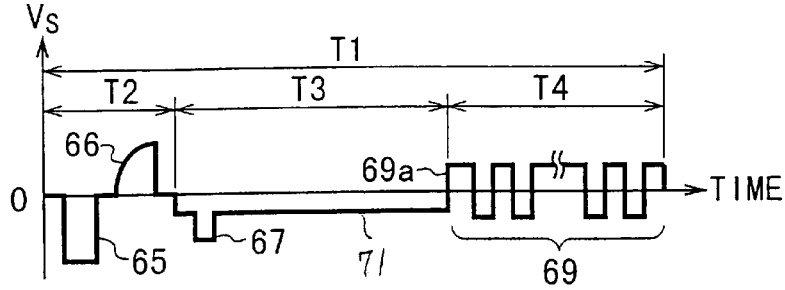
Figure 13C:
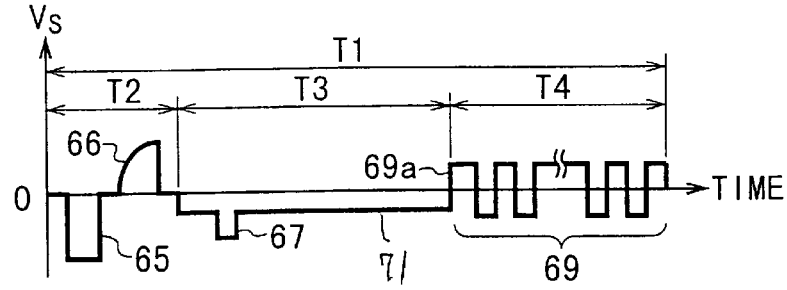
Figure 13D:
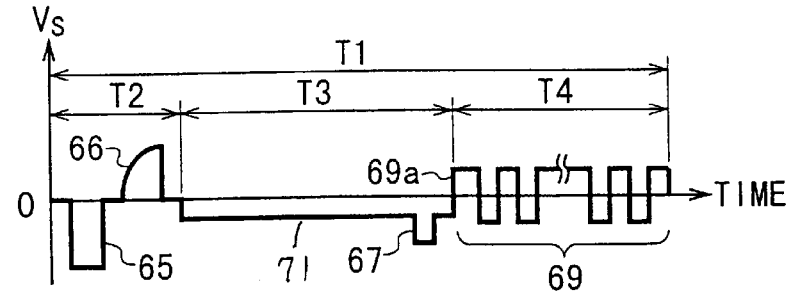
Figure 13E:
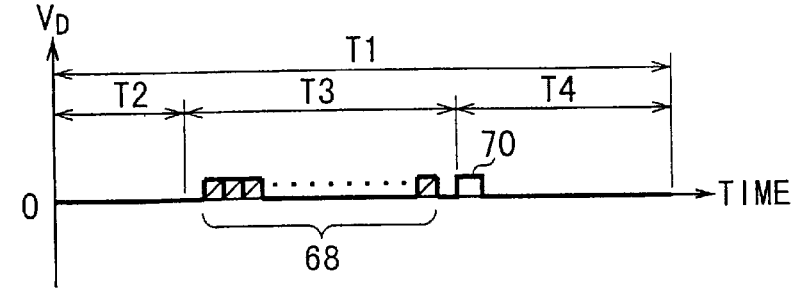

As shown in FIGS. 12A and 12E, in the preliminary discharge period T2, a first preliminary discharge pulse 45*g* is commonly applied to the scan electrodes 22 and then, a second preliminary discharge pulse 46*g* is commonly applied to the scan electrodes 22. The pulses 45*g* and 46*g* are of the positive polarity, which is the same as that of the pulses 45*a* and 46*a* used in the fifth embodiment.

A second preliminary discharge pulse 46*h* is commonly applied to the common electrodes 23 synchronized with the second preliminary discharge pulse 46*g*. The pulse 46*h* is of the negative polarity, which is the same as that of the pulses 45*a* and 46*a* used in the fifth embodiment.

A first preliminary discharge pulse is not used. Instead of this pulse, a data bias pulse 51*b* of the positive polarity is commonly applied to the data electrodes 11 synchronized with the first and second preliminary discharge pulses 45*g* and 46*g*. The voltage level of the pulse 51*b* is equal to that of the data pulses 49.

Thus, the potential difference or voltage between the scan and common electrodes 22 and 23 has an opposite polarity to that at the time when the last sustain pulse 10 is applied to the scan electrodes 22.

The voltage level of the first preliminary discharge pulse 45*g* is equal to that (160 to 180 V) of the sustain pulses 50. The voltage level of the second preliminary discharge pulse 46*g* is equal to three-seconds (3/2) (240 to 270 V) of the voltage level of the sustain pulses 50. The voltage level of the second preliminary discharge pulse 46*h* is equal to half (−80 to −90 V) of the voltage level of the sustain pulses 50. The pulse width of these pulses 45*g*, 46*g*, and 46*h* are set as 3 to 5 λsec. The pulse width of the pulse 51*b* is equal to the sum of those of the pulses 45*g* and 46*g*.

Needless to say, the method of the eighth embodiment has the same advantages as those in the fifth embodiment.

Tenth Embodiment

FIGS. 13A to 13E show a method of driving an ac-discharge type PDP according to a tenth embodiment of the invention, which uses the same steps and pulses as those in the prior-art method of FIGS. 3A to 3E, except that different pulses are used in the sustain period T4. Therefore, the explanation about the same steps and pulses is omitted here for the sake of simplification by attaching the same reference symbols as those in FIGS. 3A to 3E to the same elements in FIGS. 13A to 13E.

In the preliminary discharge period T2, a preliminary discharge pulse 65 has a voltage level of approximately −200 V and a pulse width of approximately 4 to 6 μm. A preliminary discharge elimination pulse 66 has a dull or integration waveform and a positive peak voltage level of approximately 160 to 180 V.

In the scan period T3, a scan bias pulse 71 is commonly applied to the scan electrodes 22 in the whole scan period T3. The scan bias pulses 71 have a voltage level of approximately −50 to −90 V. Scan pulses 67 are successively applied to the scan electrodes 22 to be superposed to the scan bias pulse 71. The scan pulses 67 have a voltage level of approximately −170 to −190 V. The pulses 67 has a width of approximately 2.0 to 3.0 μsec. Synchronized with the scan pulses 67, data pulses 68 are applied to the data electrodes 29 according to the display data or signal. The data pulses 68 has a voltage level of approximately 60 to 80 V. All the scan electrodes 22 (i.e., S1 to Sm) are scanned, the sustain period T4 begins.

In the sustain period T4, when a first sustain pulse 69*a* is commonly applied to the scan electrodes 22, a data bias pulse 70 is commonly applied to the data electrodes 29, where the pulse 70 has an equal voltage level to that of the data pulses 68. After the application of the pulse 69*a* is completed, the voltage level of the data electrodes 29 is lowered to the ground level.

The sustain pulses 69 including the first pulse 69*a* have positive and negative polarities. The pulses 69 are alternately applied to the scan electrodes 22 and the common electrodes 23. The application of the pulses 69 to the scan and common electrodes 22 and 23 are performed alternately in opposite polarity. The peak voltage level in each polarity is set as approximately ±75 to ±90 V.

Next, the operation of the PDP is explained below.

Since the operation in the preliminary discharge and scan periods T2 and T3 are the same as that of the prior-art method of FIGS. 3A to 3E, its explanation is omitted here.

After the scan period T3 is completed, the operation in the sustain period T4 begins in the following manner.

With the cells 31 that have not emitted light in the preceding sub-field T1, the data pulses 68 have not been applied to the data electrodes 29. Thus, the writing discharge does not occur and no wall charge is generated on any electrodes. In this case, even if the sustain pulses 69, which have a voltage level that causes no discharge, are applied to the scan and common electrodes 22 and 23 in the sustain period T4, no discharge takes place and the corresponding cells 31 does not emit light.

On the other hand, with the cells 31 that have emitted light in the preceding sub-field T1, since the data pulses 68 have been applied to the data electrodes 29, the writing discharge occurs and then, positive wall charge is generated over the scan electrodes 22 and negative wall charge is generated over the data electrodes 29. Therefore, the potential difference or voltage formed by these wall charge is approximately equal to the that given by subtracting the charge induced by the secondary discharge at the end timing of the scan pulses 67 from the sum charge induced by the scan and data pulses 67 and 68. For example, this potential difference is approximately equal to 200 to 250 V. Accordingly, when the first sustain pulse 69*a* is applied to the scan and common electrodes 22 and 23, the voltage applied across the discharge spaces 26 between the scan and data electrodes 22 and 29 is equal to approximately 195 to 280 V.

On the other hand, in the discharge spaces 26 between the scan and common electrodes 22 and 23, the wall charge existing over the scan and common electrodes 22 and 23 is superposed to the potential or voltage (approximately 150 to 180 V) induced by the sustain pulses 69.

On the common electrodes 23, the wall charge has been almost entirely eliminated in the preliminary discharge period T2. Thus, substantially, only the wall charge existing over the scan electrodes 22 is superposed to the potential induced by the sustain pulses 69. It is supposed that the writing discharge extend over the data electrodes 29 in the cells 31 and that the potential caused by the wall charge over the scan electrodes 22 is greater than two-thirds (⅔) of the potential difference between the scan pulses 67 and the data pulses 68. This means that the wall charge voltage of 130 V or greater is generated. Accordingly, the voltage applied across the discharge spaces 26 between the scan and data electrodes 22 and 29 will be 280 V (=150 V+130 V) or higher.

In general, discharge starts after the application of a voltage by a specific time lag or delay time, where the time lag varies dependent on the applied voltage. The time lag becomes shorter as the applied voltage increases. Therefore, in the tenth embodiment, surface discharge can be caused between the scan and common electrodes 22 and 23 prior to the opposing discharge between the scan and data electrodes 22 and 29. The generation of the opposing discharge between the scan and data electrodes 22 and 29 is determined by the amount of the time lag and the generation speed of the wall charge.

However, in the tenth embodiment, the generation of the surface discharge is ensured due to the above-described reason. Once the surface discharge occurs, wall charge approximately equal to the potential difference induced by the applied sustain pulses 69 is formed. As a result, due to the superposition of the wall charge, the potential difference equal to approximately twice the potential difference induced by the second to last sustain pulses 69 is applied across the scan and common electrodes 22 and 29, ensuring the sustain discharge in the sustain period T4.

As described above, with the driving method according to the tenth embodiment of FIGS. 13A to 13E, when the first sustain pulses 69*a* and 69*b* are applied to the scan and common electrodes 22 and 23, respectively, surface discharge always occurs, which prevents the fault cells 31 from being generated due to lack of the sustain discharge.

Also, when the second to last sustain pulses 69 excluding the first sustain pulses 9*a* and 9*b* are applied, the potential of the data electrodes 29 is set as approximately the ground level (i.e., 0 V). Thus, the wall charge induced on the data electrodes 29 by the writing discharge is eliminated due to attachment of charged particles caused by the sustain discharge. Since the wall charge over the-data electrodes 29 is returned to the state prior to the data writing in the sustain period T4, the state of the wall charge is reset or initialized in the next preliminary charge period T2 only between the scan and common electrodes 22 and 23. This means that the pulse count necessary for the resetting operation can be decreased compared with the prior-art method of FIGS. 3A to 3E.

Eleventh Embodiment

FIGS. 14A to 14E show a method of driving an ac-discharge type PDP according to an eleventh embodiment of the invention, which uses the same steps and pulses as those in the method according to the tenth embodiment of FIGS. 13A to 13E, except that different pulses are used in the sustain period T4. Therefore, the explanation about the same steps and pulses is omitted here for the sake of simplification by attaching the same reference symbols as those in FIGS. 13A to 13E to the same elements in FIGS. 14A to 14E.

Figure 14A:
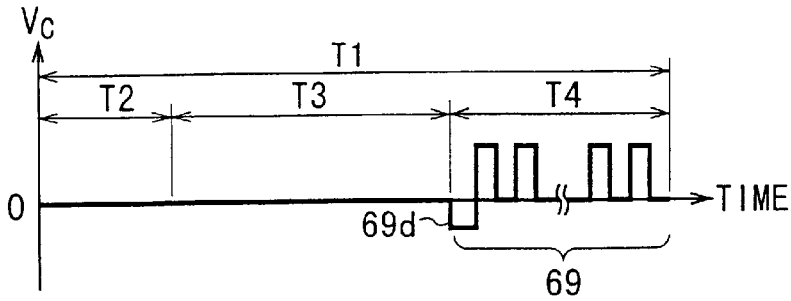
FIGS. 14A to 14E are waveform charts showing a method of driving an ac-discharge PDP according to an eleventh embodiment of the invention, respectively.
Figure 14B:
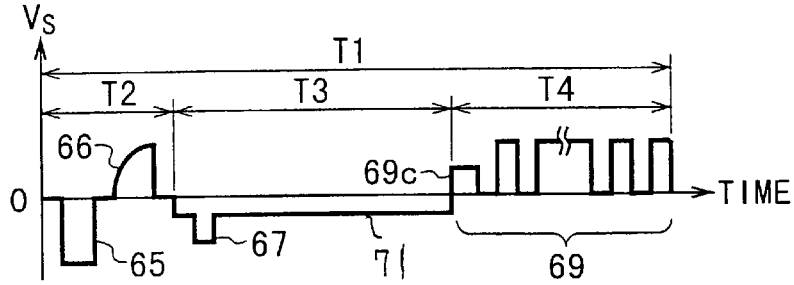
Figure 14C:
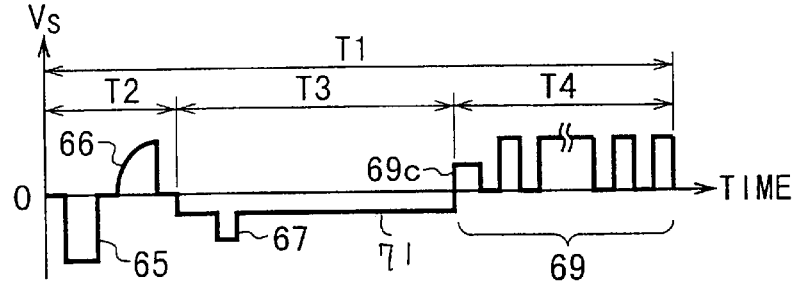
Figure 14D:
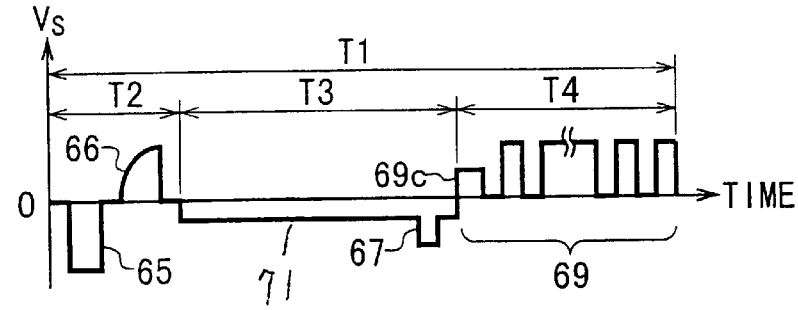
Figure 14E:
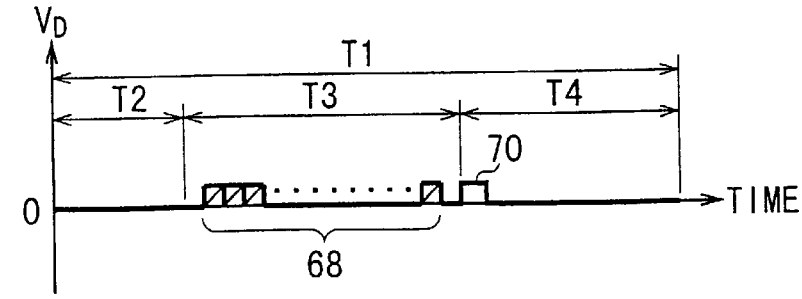
Figure 15A:
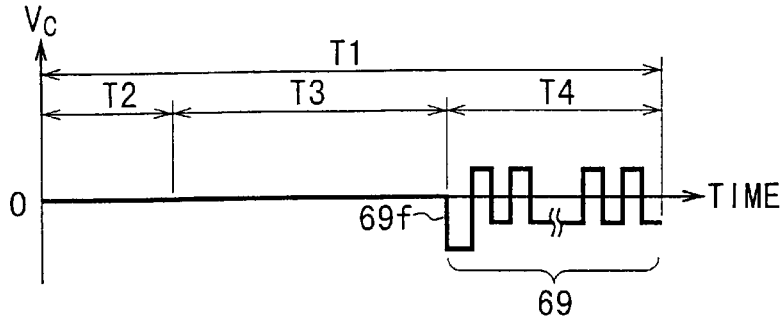
FIGS. 15A to 15E are waveform charts showing a method of driving an ac-discharge PDP according to a twelfth embodiment of the invention, respectively.
Figure 15B:
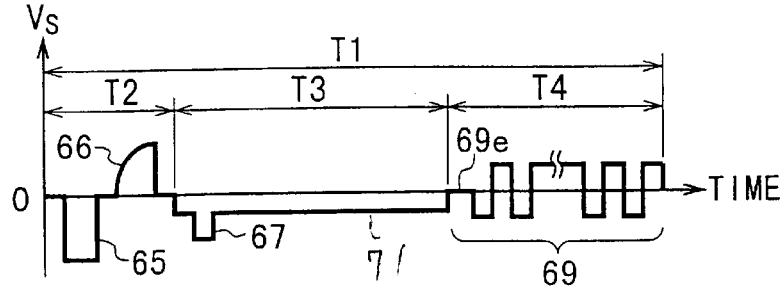
Figure 15C:
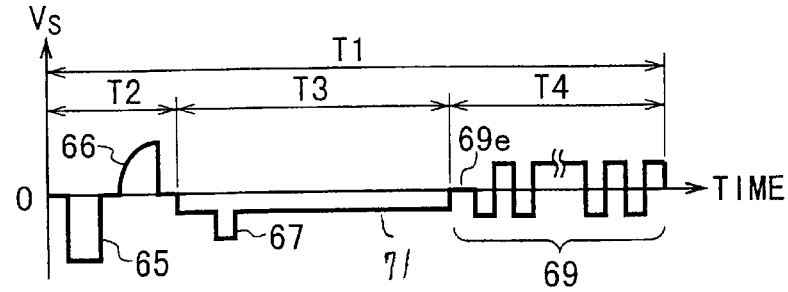
Figure 15D:
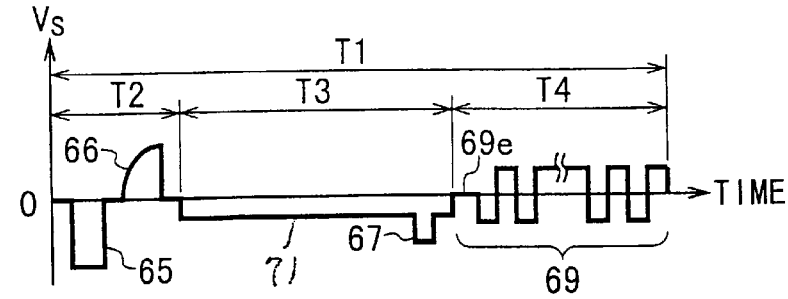
Figure 15E:
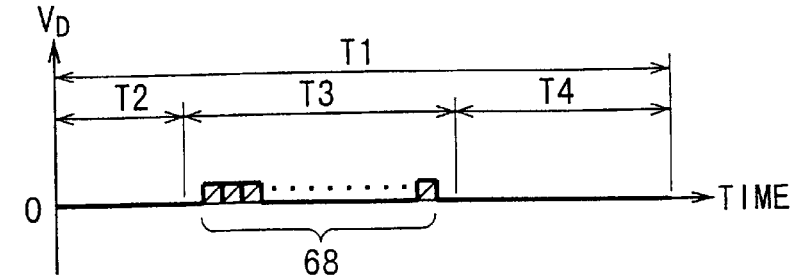

As shown in FIGS. 14A and 14E, in the sustain period T4, a first sustain pulse 69*c* of the positive polarity is commonly applied to the scan electrodes 22 and at the same time, a first sustain pulse 69*d* of the negative polarity is commonly applied to the common electrodes 23.

The second to last sustain pulses 69 for the scan and common electrodes 22 and 23, which are of the positive polarity only, are alternately applied to the scan and common electrodes 22 and 23. The amplitude of the second to last pulses 69 for the scan and common electrodes 22 and 23 is set to be equal to the voltage generated by the second to last pulses 69 used in the method of the tenth embodiment of FIGS. 13A to 13E. This point is unlike the tenth embodiment.

Since the voltage level or potential of the data electrodes 29 is the same as that of the tenth embodiment of FIGS. 13A to 13E, it is kept lower than or equal to those of the scan and common electrodes 22 and 23. Thus, at the end of the sustain period T4, positive wall charge is generated over the data electrodes 29 due to attachment or absorption of the charged particles. The positive wall charge thus generated is left in the next scan period T3 and then, it is superposed to the data pulses 68 in the same period T3, thereby causing the writing discharge.

Needless to say, there are the same advantages as those in the tenth embodiment.

Twelfth Embodiment

FIGS. 15A to 15E show a method of driving an ac-discharge type PDP according to a twelfth embodiment of the invention, which uses the same steps and pulses as those in the method according to the tenth embodiment of FIGS. 13A to 13E, except that different pulses are used in the sustain period T4.

In the sustain period T4, the second to last sustain pulses 69 are the same as those in the tenth embodiment of FIGS.

13A to 13E. However, unlike this, the voltage levels of first sustain pulses 69*e* and 69*f* are lower than those in the tenth embodiment. The voltage level of the pulse 69*e* is equal to the ground level, i.e., 0 V. The voltage level of the pulse 69*f* is set to be −150 to −180 V. Also, the voltage level of the data electrodes 29 is kept at the ground level in the whole sustain period T4. As a result, the voltage of approximately 200 to 250 V, which corresponds to the wall charge generated by the writing discharge and its secondary discharge, is applied across the space 26 between the common and data electrodes 23 and 29.

On the other hand, the voltage of approximately 150 to 180 V, which corresponds to the wall charge (which corresponds to 130 V) generated by the writing discharge, and the voltage of approximately 150 to 180 V, which is applied by the sustain pulses 69, are added to each other, forming the sum voltage of 280 V or higher. The sum voltage is applied across the space 26 between the scan and common electrodes 22 and 23.

Because of this reason, the surface discharge starts between the scan and common electrodes 22 and 23 prior to the opposing discharge between the scan and data electrodes 23 and 29. Thus, there are the same advantages as those in the tenth embodiment.

Thirteenth Embodiment

FIGS. 16A to 16E show a method of driving an ac-discharge type PDP according to a thirteenth embodiment of the invention, which uses the same steps and pulses as those in the method according to the tenth embodiment of FIGS. 13A to 13E, except that different pulses are used in the sustain period T4.

Figure 16A:
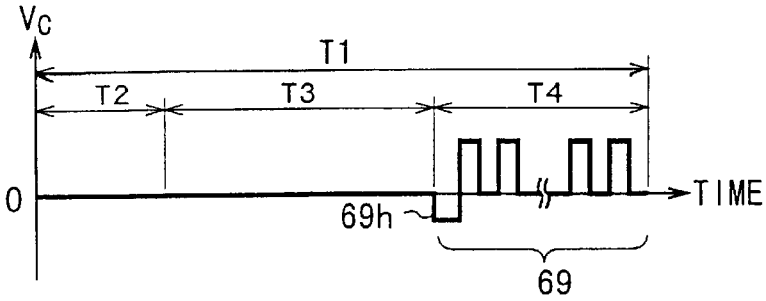
FIGS. 16A to 16E are waveform charts showing a method of driving an ac-discharge PDP according to a thirteenth embodiment of the invention, respectively.
Figure 16B:
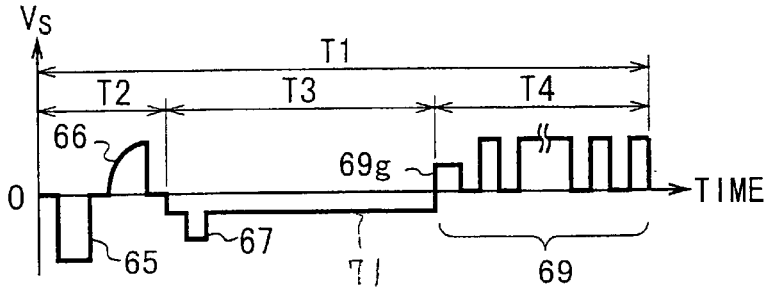
Figure 16C:
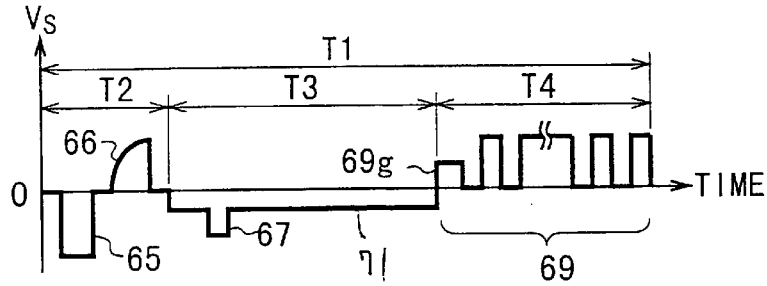
Figure 16D:
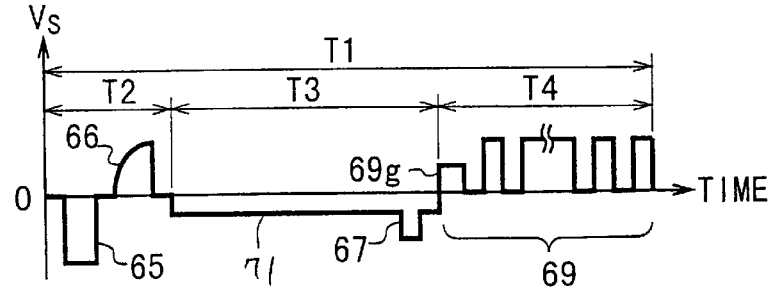
Figure 16E:
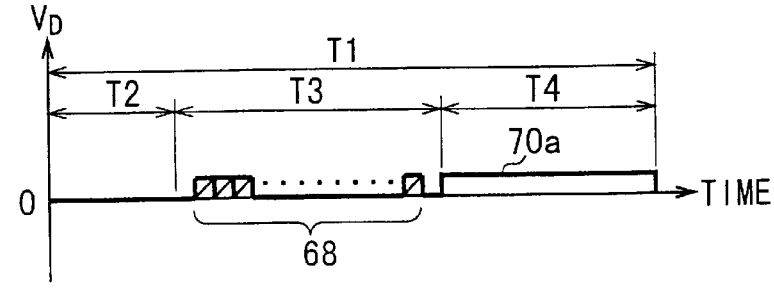

As shown in FIGS. 16A and 16E, the sustain pulses 69 applied in the sustain period T4 are the same as those in the eleventh embodiment of FIGS. 14A to 14E. Thus, first sustain pulses 69*g* and 69*h* are the same as the pulses 69*c* and 69*d* in the eleventh embodiment. Unlike the eleventh embodiment, a data bias pulse 70*a* is applied to the data electrodes 29 in the whole sustain period T4. Thus, the voltage level or potential of the data electrodes 29 is located between the voltage levels of the scan and common electrodes 22 and 23 and therefore, almost all the wall charge existing over the data electrodes 29 can be eliminated at the end of the scan period T4. This means that the resetting operation of the wall charge in the next preliminary charge period T2 can be performed by a small number of applied pulses between the scan and common electrodes 22 and 23.

Needless to say, there are the same advantages as those in the tenth embodiment.

Fourteenth Embodiment

FIGS. 17A to 17E show a method of driving an ac-discharge type PDP according to a fourteenth embodiment of the invention, which uses the same steps and pulses as those in the method according to the tenth embodiment of FIGS. 13A to 13E, except that different pulses are used in the sustain period T4.

Figure 17A:
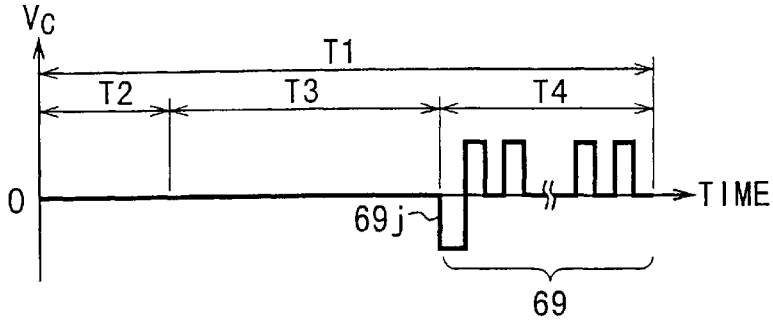
FIGS. 17A to 17E are waveform charts showing a method of driving an ac-discharge PDP according to a fourteenth embodiment of the invention, respectively.
Figure 17B:
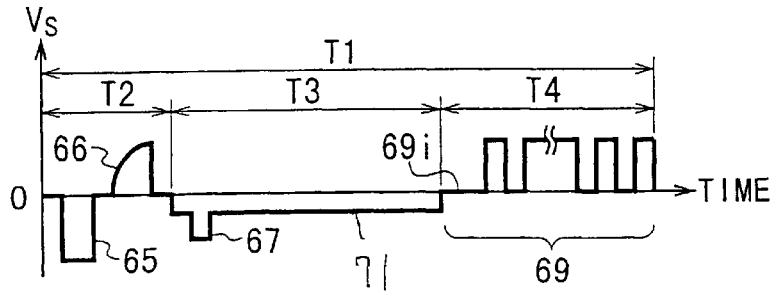
Figure 17C:
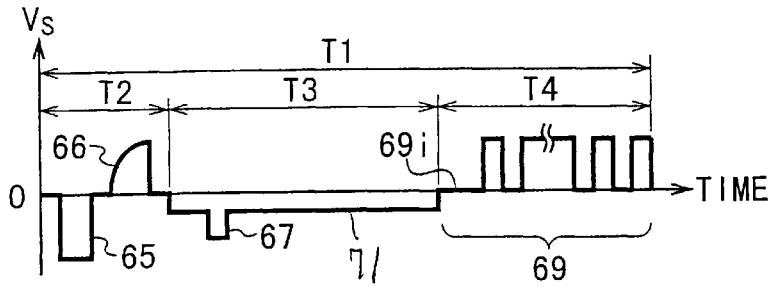
Figure 17D:
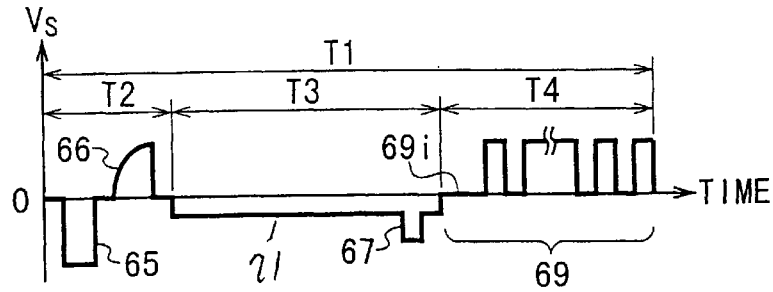
Figure 17E:
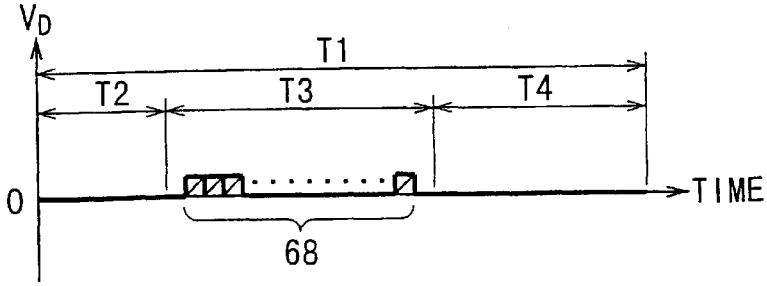
Figure 18A:
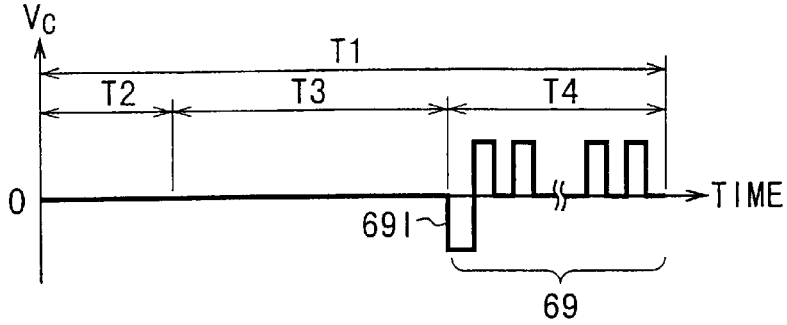
FIGS. 18A to 18E are waveform charts showing a method of driving an ac-discharge PDP according to a fifteenth embodiment of the invention, respectively.
Figure 18B:
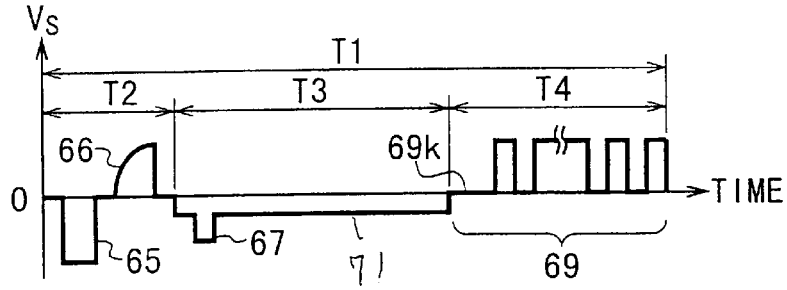
Figure 18C:
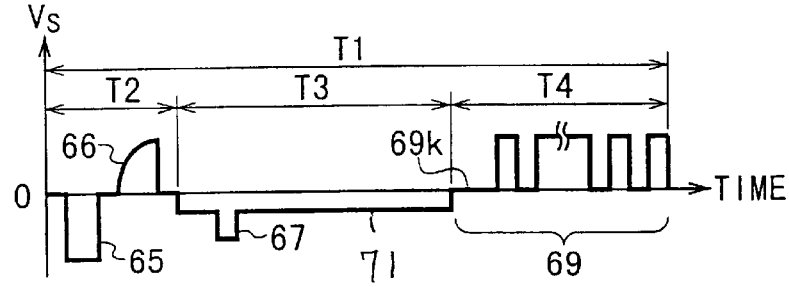
Figure 18D:
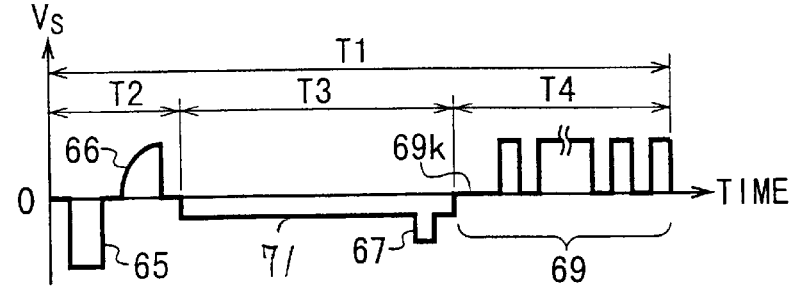
Figure 18E:
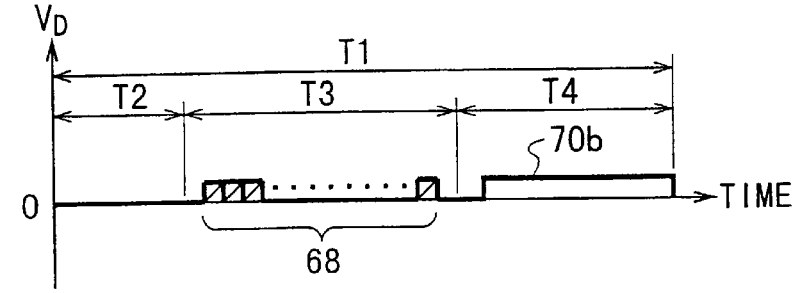
Figure 19A:
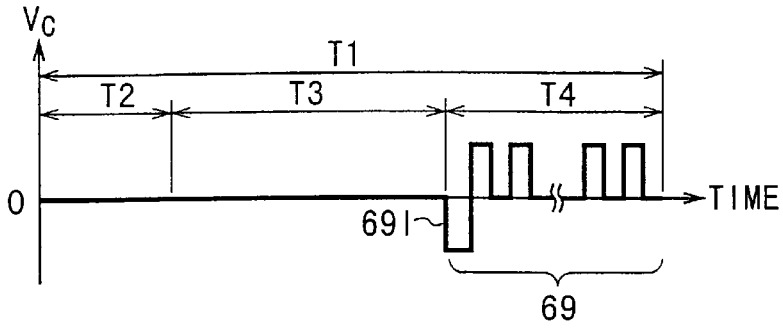
FIGS. 19A to 19E are waveform charts showing a method of driving an ac-discharge PDP according to a sixteenth embodiment of the invention, respectively.
Figure 19B:
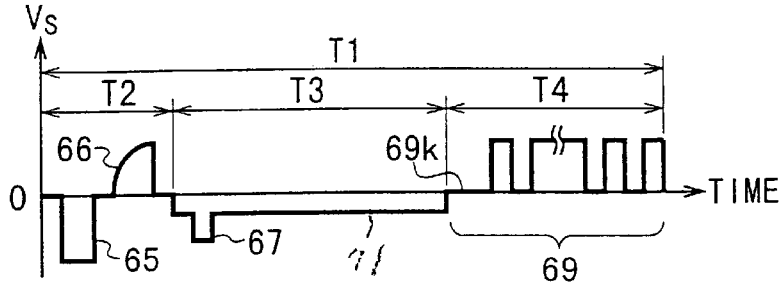
Figure 19C:
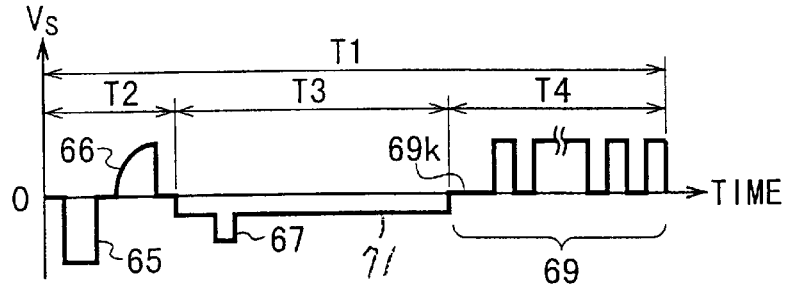
Figure 19D:
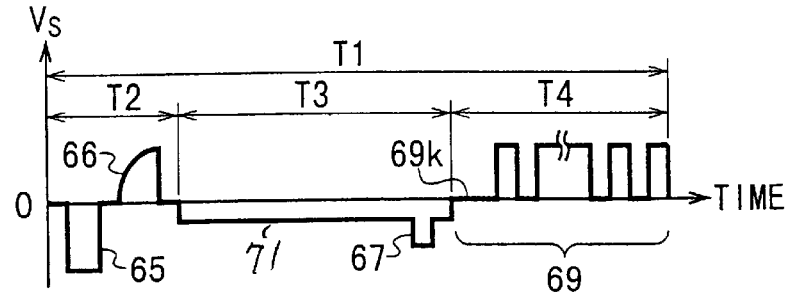
Figure 19E:
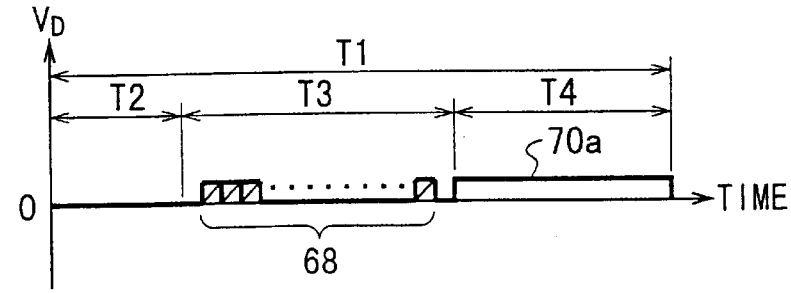

As shown in FIGS. 17A and 17E, in the sustain period T4, a first sustain pulse 69*i* having a ground voltage level is applied to the scan electrodes 22. A first sustain pulse 69*j* having a negative voltage level is applied to the common electrodes 23. The voltage levels of the pulses 69*i* and 69*j* are lower than those of the pulses 69*g* and 69*h* in the thirteenth embodiment of FIGS. 16A to 16E. The second to last sustain pulses 69 are the same as those in the thirteenth embodiment.

The data electrodes 29 is kept at the ground level in the whole sustain period T4.

Thus, in the method of the fourteenth embodiment, the voltage between the scan and data electrodes 22 and 29 is greater than that of the prior-art method of FIGS. 3A to 3E, resulting in the same advantages as those in the tenth embodiment.

Fifteenth Embodiment

FIGS. 18A to 18E show a method of driving an ac-discharge type PDP according to a fifteenth embodiment of the invention, which uses the same steps and pulses as those in the method according to the tenth embodiment of FIGS. 13A to 13E, except that different pulses are used in the sustain period T4.

A first sustain pulse 69*k* applied to the scan electrodes 22 and a first sustain pulse 691 applied to the common electrodes 23 are the same as the pulses 69*i* and 69*j* in the fourteenth embodiment of FIGS. 17A to 17E. The second to last sustain pulses for the scan and common electrodes 22 and 23 also are the same as the sustain pulses 69 in the fourteenth embodiment.

Unlike the fourteenth embodiment, in the sustain period T4, a data bias pulse 70*b* is applied to the data electrodes 29 after the first pulses 69*k* and 691 are applied to the scan and common electrodes 22 and 23, respectively. The data bias pulse 70*b* has an equal voltage level as that of the data pulses 68.

Needless to say, there are the same advantages as those in the tenth embodiment.

Sixteenth Embodiment

FIGS. 19A to 19E show a method of driving an ac-discharge type PDP according to a sixteenth embodiment of the invention, which uses the same steps and pulses as those in the method according to the fifteenth embodiment of FIGS. 18A to 18E, except that the pulse 70*b* is used in the sustain period T4. The pulse 70*b* is the same as that used in the thirteenth embodiment of FIGS. 16A and 16E.

The first sustain pulse 69*k* for the scan electrodes 22 has a negative voltage level of approximately −150 to −180 V. The voltage level of the pulse 70*a* is set to be equal to that of the data pulses 68, e.g., approximately 60 to 80 V.

When the writing discharge occurs, the voltage formed by the sum of the wall charges over the scan and common electrodes 22 and 23 is approximately 200 to 250 V, and the voltage between the scan and common electrodes 22 and 23 is approximately 60 to 80 V (which is equal to the voltage of the data bias pulse 70*a*). In this case, the former and latter voltages are opposite in polarity and therefore, the voltage applied across the space 26 between the scan and data electrodes 22 and 29 becomes approximately 140 to 170 V.

On the other hand, similar to the twelfth embodiment of FIGS. 15A to 15E, a voltage of 280 V or higher is applied across the space 26 between the scan and common electrodes 22 and 23. Thus, the surface discharge is ensured.

Needless to say, there are the same advantages as those in the tenth embodiment.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A method of driving an ac-discharge PDP, in which the PDP has row electrodes and column electrodes that form pixels arranged in a matrix array, and a dielectric layer formed to cover said pixels;

said method comprising the steps of:

(a) commonly applying a first preliminary discharge pulse to said row electrodes in a preliminary discharge period;

said first preliminary discharge pulse serving to induce discharge only when discharge has occurred in an adjoining, previous sustain period;

(b) commonly applying a second preliminary discharge pulse to said row electrodes in said preliminary discharge period;

said second preliminary discharge pulse serving to induce discharge only when discharge has not occurred in said adjoining, previous sustain period;

(c) successively applying scan pulses to said row electrodes while data pulses are applied to said column electrodes according to a display signal in a scan period subsequent to said preliminary discharge period, thereby generating wall discharge in said dielectric layer due to writing discharge; and (d) Applying sustain pulses to said row electrodes in a sustain period subsequent to said scan period, thereby causing sustain discharge;

wherein a state of wall charge that has been generated in said adjoining, previous sustain period is reset by said first or second preliminary discharge pulse for initialization in said preliminary discharge period.

2. The method according to claim 1, wherein said potential difference between said row electrodes at a time when said first preliminary discharge pulse is applied is less than that when said second preliminary discharge pulse is applied.

3. The method according to claim 1, wherein said first preliminary discharge pulse is applied to said row electrodes prior to said second preliminary discharge pulse.

4. The method according to claim 1, wherein said first and second preliminary discharge pulses are applied to the same row electrodes as those applied with said last sustain pulse in said sustain period, thereby reversing the polarity of said potential difference between said row and column electrodes.

5. The method according to claim 1, wherein said potential difference between said row and column electrodes at a time when said first preliminary discharge pulse is applied is less than that at a time when said second preliminary discharge pulse is applied by a voltage of said sustain pulse.

6. The method according to claim 1, wherein the timing of said preliminary discharge, scan, and sustain periods for all said cells are equal to each other.

7. The method according to claim 1, wherein said row electrodes of said PDP includes common electrodes and scan electrodes and said column electrodes thereof include data electrodes;

and wherein said common electrodes and said scan electrodes extend parallel to each other, and said data electrode extend perpendicular to said scan and common electrodes.

8. The method according to claim 7, wherein said first and second preliminary discharge pulses are commonly applied to said scan and common electrodes.

9. The method according to claim 7, wherein said potential or voltage of said data electrodes is set at a value existing between said potentials or voltages of said scan electrodes and said common electrodes in said preliminary discharge period.

10. The method according to claim 7, wherein said potential difference or voltage between said scan and data electrodes are set to be equal to approximately half of said potential difference or voltage between said scan and common electrodes.

11. The method according to claim 7, wherein said potential or voltage of said data electrodes in said preliminary discharge period is equal to one of two potential or voltage values of said data electrodes according to whether said cells emit light or not in said scan period.

12. The method according to claim 7, wherein said potential or voltage of said data electrodes in said preliminary discharge period is set to be approximately equal to a ground level.

13. The method according to claim 1, wherein in said preliminary discharge period, a preliminary-discharge elimination pulse is applied to said row electrodes after said first and second preliminary discharge pulses are applied;

and wherein said preliminary-discharge elimination pulse has a waveform that varies gradually its voltage value to reach a peak voltage value;

said peak voltage value being substantially equal to a potential difference or voltage between said row and column electrodes at a time when said first or second preliminary discharge pulse is applied.

* * * * *